US005804265A

United States Patent [19]

Saad et al.

[11] Patent Number: 5,804,265

[45] Date of Patent: Sep. 8, 1998

[54] FUNCTIONAL FREEZER STORAGE BAG

[75] Inventors: Zain E. M. Saad; Douglas P. Gundlach; Virginia D. Karul; Roger D. Vrooman; Michael A. Babinec, all of Midland; Linda W. Allison, Sanford; Claudia J. Gerardo, Midland, all of Mich.

[73] Assignee: S. C. Johnson Home Storage Inc., Racine, Wis.

[21] Appl. No.: 601,602

[22] Filed: Feb. 14, 1996

Related U.S. Application Data

[63] Continuation-in-part of Ser. No. 296,785, Aug. 26, 1994, abandoned.

[51] Int. Cl.[6] ..... B65B 65/00; B65D 33/00

[52] U.S. Cl. ..... 428/35.2; 428/103; 428/131; 428/195; 428/198; 428/216; 428/219; 428/340; 383/100; 383/102; 383/109; 383/113; 426/127; 426/129; 426/415; 426/418; 206/484; 206/484.1; 206/524.2

[58] Field of Search ..... 428/35.2, 36.7, 428/103, 131, 195, 198, 213, 216, 219, 340; 206/204, 205, 213.1, 484, 484.1, 524.2, 524.6, 524.7; 383/100, 101, 102, 109, 113; 426/106, 127, 129, 415, 418, 419

[56] References Cited

U.S. PATENT DOCUMENTS

| | | | |
|---|---|---|---|
| 2,638,952 | 5/1953 | Sanderson | 150/49 |
| 3,494,457 | 2/1970 | Titchenal | 206/46 |
| 3,734,394 | 5/1973 | Dooley | 229/55 |
| 4,172,152 | 10/1979 | Carlisle | 426/127 |
| 4,186,786 | 2/1980 | Kirkpatrick | 150/3 |
| 4,211,091 | 7/1980 | Campbell | 62/372 |
| 4,211,267 | 7/1980 | Skovgaard | 150/2.1 |
| 4,323,586 | 4/1982 | Long | 426/412 |
| 4,358,466 | 11/1982 | Stevenson | 426/106 |

(List continued on next page.)

FOREIGN PATENT DOCUMENTS

| | | | |
|---|---|---|---|
| 0 373 506 A1 | 6/1990 | European Pat. Off. . | |
| 1294473 | 11/1989 | Japan . | |
| 3226475 | 10/1991 | Japan . | |
| 3289470 | 12/1991 | Japan . | |
| 3289474 | 12/1991 | Japan . | |
| 431284 | 2/1992 | Japan . | |
| 5338639 | 12/1993 | Japan . | |
| 2 097 361 | 11/1982 | United Kingdom . | |
| 2228724 | 9/1990 | United Kingdom | 428/35.7 |
| 2273488 | 6/1994 | United Kingdom . | |
| WO 95/18754 | 7/1995 | WIPO . | |

OTHER PUBLICATIONS

Jenkins & Harrington, *Packaging Foods With Plastics,* (1991), pp. 109–121 & 305.

Consumer Reports, *Keeping Food Fresh,* (Mar. 1994), pp. 143–147.

U.S. Dpt. Agri. Home & Garden Bulletin No. 10, *Home Freezing of Fruits and Vegetables,* (1981).

Hodges, *Rodale's Complete Book of Home Freezing,* (1984), pp. 173–174.

Webster's Complete Dictionary, p. 1486.

EM Material Safety, Polymer Films Inc. (Jun. 1986, pp. 1–2.

New Improved ZIPLOC® Freezer Bags, an example of a visual concept evaluated by consumers. (1995).

*Primary Examiner*—Rena Dye

[57] ABSTRACT

The present invention provides a freezer bag comprising a multibag having at least an inner liner bag and an outer support bag, the inner liner bag having a first sidewall and a second sidewall attached together along respective lateral edges forming edge seals, each sidewall having a top edge, and the liner bag having a folded edge defining the bottom of the liner bag, the outer support bag having two sidewalls attached together along respective lateral edges forming edge seals, each sidewall having top edges defining the opening to the multibag, and the support bag having a folded edge defining the bottom of the multibag, the top edges of the liner bag being attached to an inner surface of each respective sidewall of the support bag wherein the liner is thermoplastic and has a thickness of less than 2.0 mil (50.8 micron).

27 Claims, 9 Drawing Sheets

U.S. PATENT DOCUMENTS

| | | | |
|---|---|---|---|
| 4,411,919 | 10/1983 | Thompson | 426/412 |
| 4,428,788 | 1/1984 | Kamp | 156/66 |
| 4,481,669 | 11/1984 | Pezzana et al. | 383/94 |
| 4,735,308 | 4/1988 | Barner | 206/204 |
| 4,741,789 | 5/1988 | Zieke et al. | 156/66 |
| 4,743,123 | 5/1988 | Legters et al. | 383/103 |
| 4,797,010 | 1/1989 | Coelho | 383/109 |
| 4,861,632 | 8/1989 | Caggiano | 428/35.2 |
| 4,951,666 | 8/1990 | Inman et al. | 128/402 |
| 4,993,844 | 2/1991 | Robinson et al. | 383/38 |
| 5,005,679 | 4/1991 | Hjelle | 190/110 |
| 5,049,223 | 9/1991 | Dais et al. | 156/244.11 |
| 5,176,251 | 1/1993 | Davis et al. | 206/205 |
| 5,256,428 | 10/1993 | Lustig et al. | 426/127 |
| 5,281,027 | 1/1994 | Thrall | 383/88 |
| 5,302,402 | 4/1994 | Dudenhoeffer et al. | 426/129 |
| 5,310,587 | 5/1994 | Akahori et al. | 428/35.2 |
| 5,328,705 | 7/1994 | Wilhoit et al. | 426/113 |
| 5,372,429 | 12/1994 | Beaver, Jr. et al. | 383/109 |
| 5,405,561 | 4/1995 | Dais et al. | 264/40.1 |
| 5,419,448 | 5/1995 | Watson | 220/4.28 |

FUNCTIONAL FREEZER STORAGE BAG

RELATED APPLICATIONS

This application is a Continuation-in-Part of application Ser. No. 08/296,785 entitled "A Functional Freezer Bag," filed Aug. 26, 1994, now abandoned.

BACKGROUND OF THE INVENTION

This invention generally concerns the packaging of food, particularly meat. The invention was made during attempts to make improved functional "freezer bags" for repackaging and freezer storing uncooked red meat by the ultimate consumer in a manner that reduces so called "freezer burn". However, various aspects of the invention also apply to the commercial packaging or repackaging of food, such as by a supermarket or even by butchers at a slaughterhouse. Other aspects of the invention include methods for preparing the improved freezer bags; methods for using the bags; the packages of meat; and certain types of thermoplastic film being particularly suitable for use as meat-contacting packaging material.

Reclosable plastic storage bags are extremely old in the art. Today, plastic bags are typically available to the public in cartons identified for specific recommended "end use" (such as Storage Bags, Heavy Duty Freezer Bags, Vegetable Bags, Trash Bags). Often the bag itself is labeled by "end use", e.g. "ZIPLOC® BRAND Heavy Duty Freezer Bags".

The term "freezer bag" is hereby defined as a bag having significant functional utility in the storage of food in a freezer. "Freezer Bags" are typically available in the following sizes: 2 gallon; 1 gallon; pleated ½ gallon; quart; and pint.

The term "freezer burn" is hereby defined as the name for the dehydration that occurs when unpackaged or improperly packaged food is stored in the low humidity atmosphere of a freezer (see "Packaging Foods With Plastics", by Wilmer A. Jenkins and James P. Harrington, published in 1991 by Technomic Publishing Co., Inc., at page 305). Consumers typically describe freezer burn in terms of three main visual attributes: ice crystal formation, product dehydration, and color change.

Freezer burn has remained a major complaint among consumers despite the commercial success of thick plastic freezer bags. In the short term, freezer burn can be a reversible process. In the long term, however, freezer burn causes a complex deterioration of food quality involving undesirable texture changes followed by chemical changes such as degradation of pigments and oxidative rancidity of lipids. Taste, aroma, mouth feel and color can all be ruined. Freezer burn of raw red meat is particularly critical because of its impact upon the color of the meat.

Aforementioned "Packaging Foods With Plastics" provides an excellent state of the art summary, with all the information on (commercial) "packaging fresh red meat collected in Chapter Seven". Curiously, the book does not appear to mention freezer burn, apart from defining it in the glossary.

"Keeping Food Fresh" is the title of an article in "Consumer Reports", for March, 1994, at pages 143–147. The article is too recent to be available as prior art against this U.S. patent application. Nevertheless its contents are of interest in showing the absence of certain types of prior art, and therefore enhancing the patentability of the present invention.

The "Consumer Reports" article attempts to answer the question as to which packaging material (plastic, aluminum, waxed paper, bags, wraps or reusable containers) do the best job of (1) keeping food fresh for "the long haul", (2) at lowest overall cost, and (3) with minimum adverse environmental impact. It "top rates" ZIPLOC® Pleated Freezer Bags (at page 145). It points out that food stored in plastic containers can suffer from freezer burn if the container contains too much air. Concerning "wraps" (plastic films and freezer papers) it advised against double wrapping because of cost and environmental reasons and "our tests showed that double wrapping doesn't afford much extra protection any way". Nowhere does the article disclose or suggest the invention described hereinafter.

The patent literature contains descriptions of various types of bag having liners or double walls including some space between the walls. Some of these patents relate to the transportation and storage of food. U.S. Pat. No. 4,211,091 (Campbell) concerns an "Insulated Lunch Bag". U.S. Pat. No. 4,211,267 (Skovgaard) describes a "Carrying Bag" for "getting home with frozen food before it thaws". U.S. Pat. No. 4,797,010 (assigned to Nabisco Brands) discloses a duplex paper bag as a "reheatable, resealable package for fried food". U.S. Pat. No. 4,358,466 (assigned to The Dow Chemical Company) relates to an improved "Freezer To Microwave Oven Bag". The bag is formed of two wing shaped pouches on each side of an upright spout. U.S. Pat. No. 5,005,679 (Hjelle) concerns "Tote Bags Equipped With A Cooling Chamber". All of these food bags appear to have very thick food contacting walls compared to the invention described hereinafter. None of these patents appear to focus on freezer burn.

Books on "Home Freezing" are of interest to this invention. Concerning "Wrapping Meat for the Freezer", the book "Rodale's Complete Book of Home Freezing" by Marilyn Hodges and the Rodale Test Kitchen staff (1984) suggested the hardly convenient method of wrapping meat chunks in a single layer of freezer paper and "sucking out the air with a straw" (trying to avoid getting blood into one's mouth) in order to reduce the amount of dehydration in the freezer (see page 173).

There is clearly still a great need to improve existing methods of packaging fresh meat, as determined by consumer surveys, coupled with the fact that there is a huge retail market in the U.S. alone, consuming multi millions of dollars worth of plastic packaging materials annually.

In contrast to the known prior art, it has now been surprisingly discovered that certain types of multiple walled plastic bags (defined herein as "multibags") are better than corresponding single wall freezer bags (having equal or greater weight than the multiple walled bags) for use as a functional freezer bag for preserving meat without freezer burn.

SUMMARY OF THE INVENTION

In its broadest scope, the present invention provides a freezer bag comprising a multibag having at least an inner liner bag and an outer support bag, the inner liner bag having a first sidewall and a second sidewall attached together along respective lateral edges forming edge seals, each sidewall having a top edge, and the liner bag having a folded edge defining the bottom of the liner bag, the outer support bag having two sidewalls attached together along respective lateral edges forming edge seals, each sidewall having top edges defining the opening to the multibag, and the support bag having a folded edge defining the bottom of the multibag, the top edges of the liner bag being attached to an inner surface of each respective sidewall of the support bag wherein the liner is thermoplastic and has a thickness of less than 2.0 mil (50.8 micron).

Further according to the present invention, there is a process for making multibags having at least an inner liner bag and an outer support bag comprising the steps of forwarding a first thermoplastic film having a thickness of greater than 1 mil and a first transverse web width, forwarding a second thermoplastic film having a thickness of less than 2 mil and a second transverse web width, the second transverse web width being smaller than the width of the first thermoplastic film, overlaying the second thermoplastic film onto the first thermoplastic film between the edges of the first film, attaching the second thermoplastic film to the first thermoplastic film along the parallel edges of the second thermoplastic film, folding the films in the transverse direction, and seal cutting the folded films to form bags.

Further according to the present invention, there is a process for heat sealing at least two film webs comprising the steps of providing at least first and second film webs capable of being heat sealed together, overlaying the second film web onto the first film web, providing at least one sealing band of material having a temperature, mass, and heat capacity sufficient to heat seal the second thermoplastic film to the first thermoplastic film, and applying said band of sealing material to the overlayed film webs. Preferably, the band seal is compressed between rollers after having been applied.

Further according to the present invention is a process for attaching at least two film webs comprising the steps of providing at least first and second film webs having first and second widths respectively, overlaying the second film web onto the first film web between parallel edges of the first film web, providing at least one sealing band of material capable of being heat sealable to at least a portion of both film webs, and applying said sealing band of material along and over parallel edges of the second film web.

Further according to the present invention is an apparatus for making multibags having at least an inner liner bag and an outer support bag comprising means for forwarding a first thermoplastic film web having a thickness of greater than 1 mil and a first transverse web width between parallel edges, means for forwarding at least a second thermoplastic film web having a thickness of less than 2 mil and a second transverse web width between parallel edges, the second transverse web width being smaller than the width of the first thermoplastic film, means for overlaying the second thermoplastic film web onto the first thermoplastic film web between the parallel edges of the first film web, means for attaching the second thermoplastic film web to the first thermoplastic film web along parallel edges of the second thermoplastic film, means for folding the films in the transverse direction, and means for seal cutting the folded films to form bags.

Further according to the present invention is an apparatus for attaching at least two film webs comprising means for providing at least first and second film webs having first and second widths respectively, means for overlaying the second film web onto the first film web between parallel edges of the first film web, means for providing at least one sealing band of material capable of being heat sealable to at least a portion of both film webs, and means for applying said sealing band of material along and over parallel edges of the second film web.

DETAILED DESCRIPTION OF THE INVENTION

Certain terms used in this specification are hereby defined as follows:

"Multiwall bag" is a bag having walls made up of more than one layer.

A "double bag" is two bags, one within the other, which double bag can be separated into two separate bags, which separate bags can then reform the double bag (as for bagging groceries at a supermarket).

A "duplex bag" is hereby defined as an integral bag consisting of an outer support bag and an inner liner bag, wherein the liner bag is partly (but not completely) joined to the support bag.

A "multibag" is hereby defined as an integral bag having at least an outer support bag and an inner liner bag, wherein the liner bag is partly (but not completely) joined to the support bag; and optionally additional layers between the liner bag and the support bag. The simplest form of a multibag is a duplex bag.

Figure 1A:
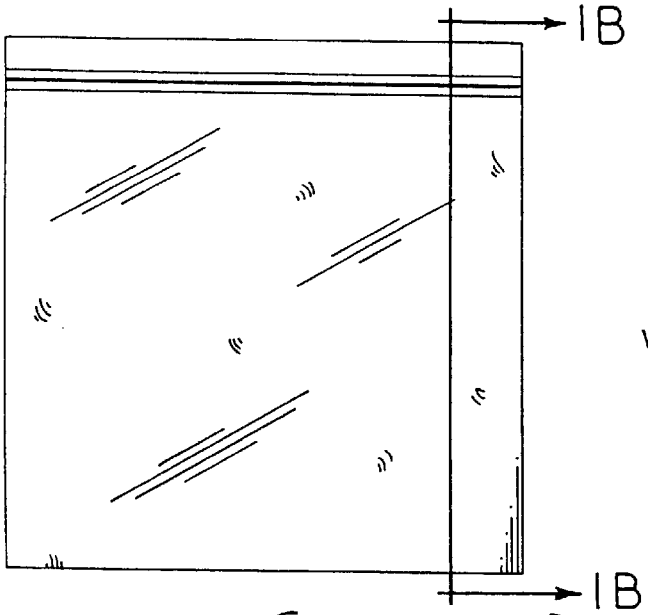
FIG. 1A (PRIOR ART)
FIG. 1A is a front elevational view of a prior art reclosable thermoplastic single wall bag having a zipper.
Figure 1B:
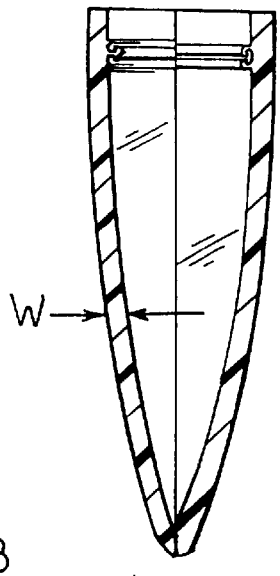
FIG. 1B (PRIOR ART)
FIG. 1B is a cross-sectional view taken along reference line 1B—1B of FIG. 1A.
Figure 2A:
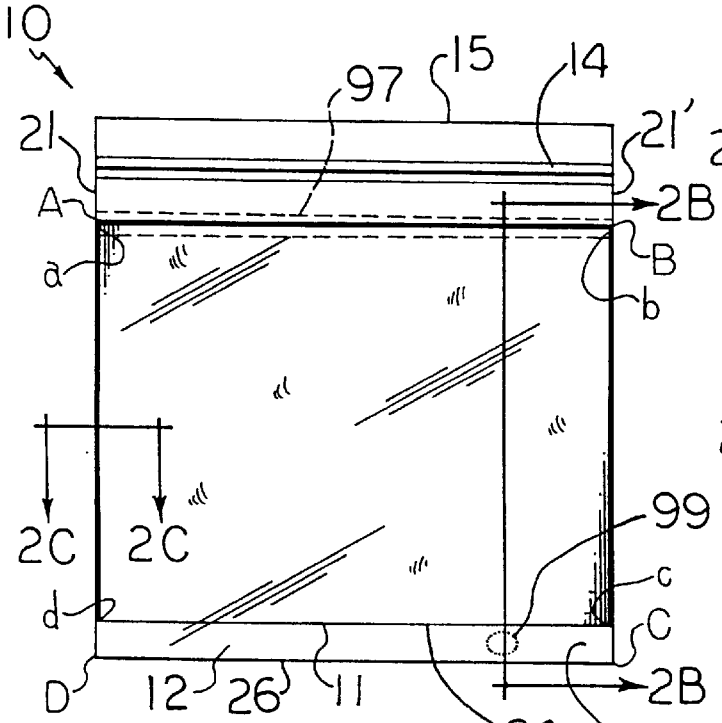
FIG. 2A is a front elevational view of a double wall bag in accordance with the present invention, (i) having a thin inner wall or liner, and (ii) having "common side seals" between the inner and outer walls and, optionally, (iii) a vent through the outer wall to connect the space between the inner and outer walls to the atmosphere outside the outer wall.
Figure 2B:
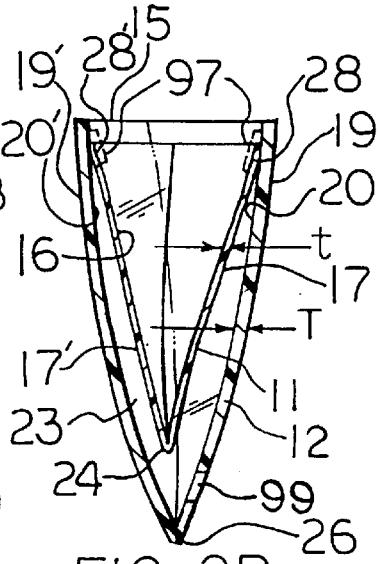
FIG. 2B is a partial cross-sectional view taken along line 2B—2B of FIG. 2A.
Figure 2C:
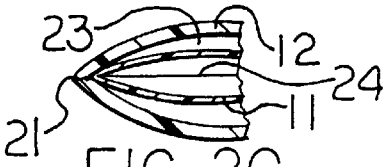
FIG. 2C is a partial cross-sectional view taken along line 2C—2C of FIG. 2A.

An embodiment of the multibag of the present invention is shown generally in FIGS. 2A–2C. As shown in FIG. 2A, multibag 10 comprises an outer bag or support bag 12 and an inner bag or liner bag 11. Support bag 12 is defined by edge seals 21, 21' and folded edge 26 shown by line DC. Support bag 12 has a reusable closure means 14, such as a mateable male and female closure, for releasably closing multibag 10. Support bag 12 has a venting means such as vent hole 99 through sidewall 19. Liner bag 11 has edge seals shown by lines ad and bc and a folded edge 24 defined by line dc. Liner bag 11 and support bag 12 share edge seals, that is, edge seals shown by lines ad and bc are common with a portion of the total length of edge seals 21, 21'.

Referring to FIGS. 2A and 2B, liner bag top edges 28, 28' are attached longitudinally across inside surfaces 20, 20' of support bag sidewalls 19, 19' forming liner bag throat or opening 13. The liner bag is longitudinally attached to the support bag at a preselected distance from multibag opening 15. Alternate means of attaching liner bag top edges 28, 28' to support bag sidewalls 19, 19' are described below.

Figure 6A:
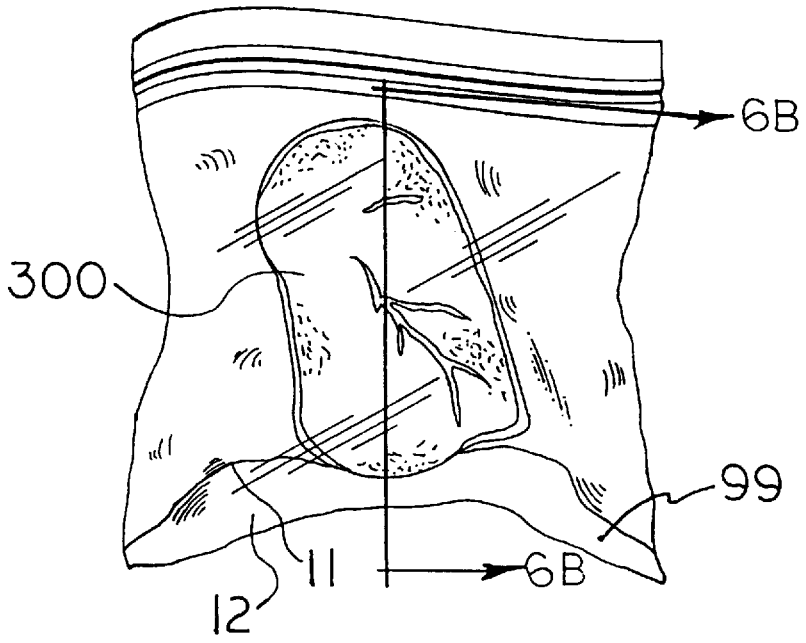
FIG. 6A is a front elevational view of a package of "meat in a closed bag" of the invention.
Figure 6B:
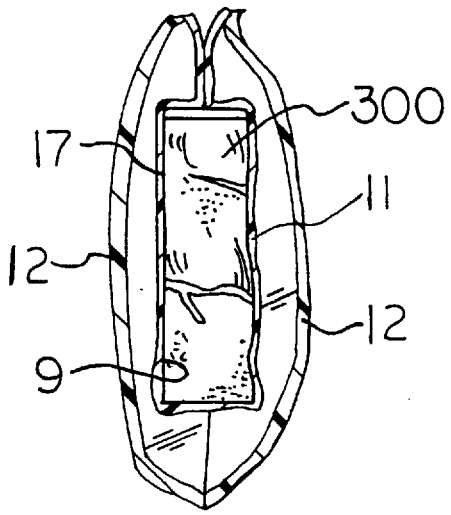
FIG. 6B is a cross-sectional view taken along reference line 6B—6B of FIG. 6A.

As shown in more detail in FIGS. 2B and 2C, support bag sidewalls 19, 19' and liner bag sidewalls 17, 17' are generally separable from one another except at edge seals shown by lines ad, bc, and attachment ab and have a space 23 therebetween. As shown in FIG. 2B, liner bag 11 is attached longitudinally across support bag sidewalls 19, 19' at liner bag edges 28, 28' such that when closure 14 is pulled apart to form opening 15, foodstuffs are placed into the liner bag 11 through opening 15 and liner bag opening 13 and the food stuff contacts the liner bag 11 and with minor manipulation of the bag, the liner bag 11 conforms to the shape of the foodstuff as shown in FIGS. 6A and 6B.

Closure means 14 may be any reusable closure. Examples of useful reusable closures and how they are made and attached to bags are found in for example, U.S. Pat. No. 4,561,109, U.S. Pat. No. 4,363,345, U.S. Pat. No. 4,528,224, and U.S. Pat. No. 5,070,584 all of which are incorporated herein by reference.

One or more vent holes 99 may generally be placed anywhere through at least one sidewall 19 or 19' of support bag 12 or anywhere through at least one liner bag sidewall 17 or 17' or through both sidewalls of both liner bag and support bag or through one sidewall of each of liner bag and support bag. One or more vent holes 99 may also be placed through either liner bag folded edge 24 or support bag folded edge 26 or both liner bag and support bag folded edges 24, 26. Support bag 12 preferably has more than one vent hole 99 and the vent hole 99 is preferably in a sidewall 19 of the support bag 12 below the seal area where the liner bag 11 is attached to the sidewalls 19, 19' of the support bag 12. Vent hole 99 provides venting of the support bag 12 to the surrounding atmosphere and permits an air space 23 between sidewalls 17, 17' of liner bag 11 and sidewalls 19, 19' of support bag 12.

Venting to the outside atmosphere increases the amount of cling or surface area contact of the liner bag film to meat. Venting permits the inner liner to cling to the meat by allowing the liner bag to move more independently of the support bag than it otherwise would if the space between the two film layers was closed and of a fixed volume. The support bag film is generally more stiff than the liner bag film and the stiffer support bag film tends to pull the liner bag off of the meat if no venting occurs. Having vent holes in the support bag also prevent air bubbles from forming in between the film layers and prevent the film layers from sticking together during manufacture of the multibag.

The number and diameter of the vent holes in either or both the liner bag and support bag should be as few and as small as possible so to make the holes less visible to the consumer. However, the vent holes need to be large enough to allow the continuous expelling of air from between film layers during manufacture and to allow the consumer to hand-expel air from between the liner bag and support bag during use. Thus, the number of vent holes needed in either or both bags will generally vary with the size of the vent holes.

Generally, there is at least one vent hole in either the support bag or the liner bag and practically there is no upper limit to the number of vent holes in either or both of the liner and support bags. The number of vent holes in either the liner bag or support bag or in both liner bag and support bags may vary from at least 1 to about 28, preferably the number of vent holes range from about 6 to about 28 and more preferably range in number from about 9 to about 17. Generally, the diameters of the vent holes are greater than about 450 microns, preferably from about 450 to about 750 microns, and more preferably from about 450 to about 500 microns in diameter.

The means of attaching a liner bag to a support bag to form a multibag of the present invention may be any means known in the art. The liner bag may be attached continuously and uniformly along liner bag top edges or attached in a discontinuous or intermittent manner along liner bag top edges. Useful examples of attaching means known in the art include hot air hem sealing, extrusion lamination (extruded thermoplastic film between the film layers), hot melt adhesive (placed over or under the top edges of the liner bag), heated bar heat sealing, ultrasonic sealing, heated rollers or belts, adhesive film strips, infrared sealing, radio frequency sealing, or vibration welding. The liner bag may also be attached to the support bag during manufacture by means of post-applying closure profiles onto and over edges of liner bag film described hereinafter. Use of any of the above means of attaching two film webs largely depends on the chemical and physical characteristics of the film webs used to make the liner bag and the support bag. Preferably, liner bag 11 is attached to support bag 12 along top edges 28, 28' by means of a hinge-type blanket seal 97 described in more detail hereinafter and shown in FIG. 9C.

To use a multibag of the present invention, the user would place the food or meat to be packaged into the liner bag through the opening in the multibag, stroke the food or meat with the hand through the bag thereby causing the liner bag to conform to the external geometry of the food or meat at the meats surface 9 and thereby exhausting air from the liner bag, and thereafter close the support bag while avoiding significant re-entry of air into the liner bag. FIGS. 6A and 6B show meat 300 packaged in a multibag having an inner liner bag 11 and an outer support bag 12.

Figure 3A:
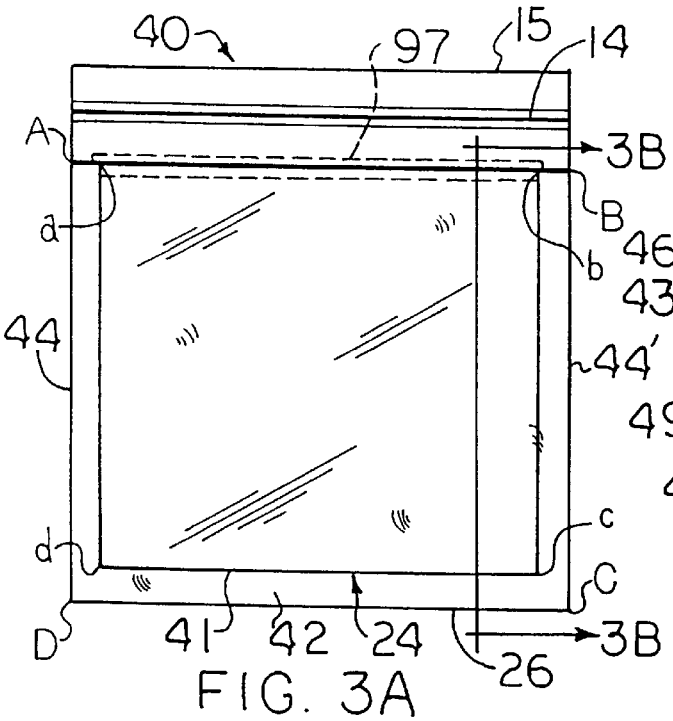
FIG. 3A is a front elevational view of another double wall bag of the present invention, with "separate side seals" and having the liner bag attached longitudinally across the total length of inside surfaces of the support bag sidewalls.
Figure 3B:
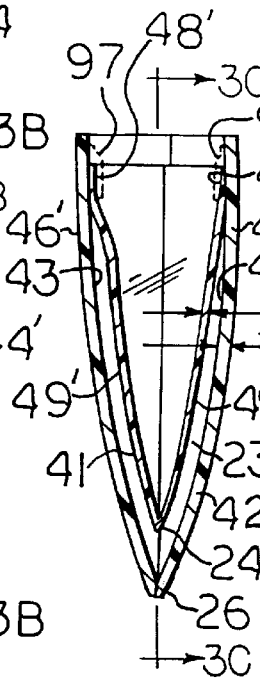
FIG. 3B is a partial cross-sectional view taken along line 3B—3B of FIG. 3A.
Figure 3C:
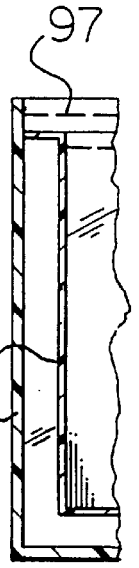
FIG. 3C is a cross-sectional view taken along line 3C—3C of FIG. 3B.

Another embodiment of the multibag of the present invention is shown in multibag 40 of FIG. 3A and in FIGS. 3B–3C. Multibag 40 comprises a liner bag 41 and a support bag 42. Support bag 42 has a reusable closure means 14 and edge seals 44, 44' joining sidewalls 46, 46' (FIG. 4B) and a folded edge 26. Liner bag 41 has edge seals shown by lines ad and bc joining sidewalls 49, 49' (FIG. 4B) and a folded edge 24. Referring to FIGS. 3B and 3A, top edges 48, 48' of liner bag 41 are attached longitudinally across inside surfaces 43, 43' of support bag sidewalls 46, 46' forming liner bag opening 13. Edge seals bc and ad of liner bag 41 are "separate" from edge seals 44, 44' of support bag 42, in contrast to edge seals bc and ad of multibag 10 shown in FIG. 2A which are "common" with a portion of edge seals 21, 21' of support bag 26. As in the embodiment shown in FIG. 2A, support bag sidewalls 46, 46' and liner bag sidewalls 49, 49' have a space 23 therebetween. The liner bag 41 may be attached to support bag 42 along liner bag top edges 48, 48' by attaching means described hereinbefore. Preferably, liner bag 41 is attached to support bag 42 along liner bag top edges 48, 48' by means of a hinge-type blanket seal 97, described hereinafter and shown in more detail in FIG. 9C.

Figure 4A:
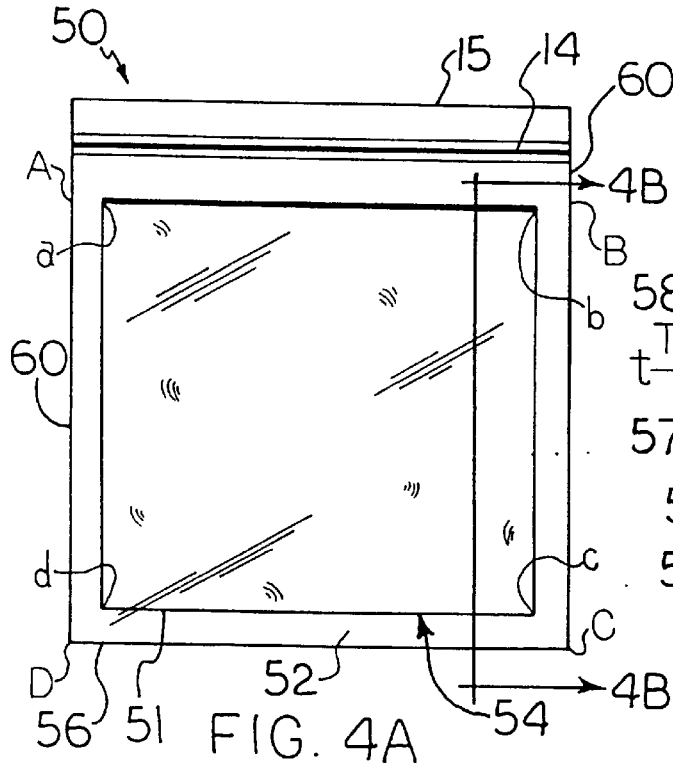
FIG. 4A is a front elevational view of a further double wall bag of the present invention having the liner bag attached longitudinally across a portion of the total length of the inside surfaces of support bag sidewalls, wherein the space between the liner bag and support bag walls is connected with the space within the liner bag.
Figure 4B:
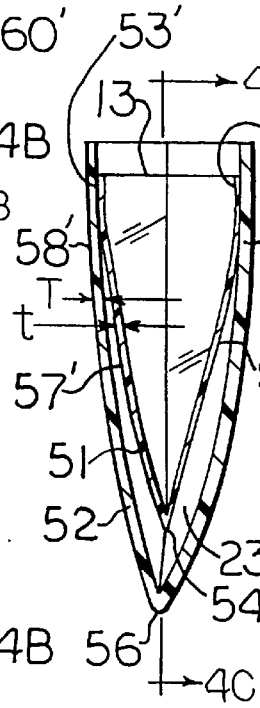
FIG. 4B is a partial cross-sectional view taken along line 4B—4B of FIG. 4A.
Figure 4C:
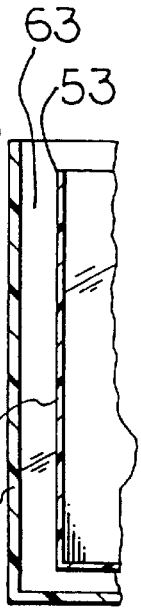
FIG. 4C is a partial cross-sectional view taken along line 4C—4C of FIG. 4B.

Another embodiment of the multibag of the present invention is shown in multibag 50 of FIG. 4A and in FIGS. 4B–4C. Multibag 50 comprises a liner bag 51 and a support bag 52 having a reusable closure means 14 near the top of the bag. Liner bag 51 defines edge seals ad and bc joining sidewalls 57, 57' (FIG. 4B) and has folded edge 54. Support bag has edge seals 60, 60' joining sidewalls 58, 58' (FIG. 4B) and has a folded edge 56. As shown more clearly in FIG. 4B, liner bag top edges 53, 53' are attached longitudinally across to inside surfaces 59 of sidewalls 58, 58' along line ab as shown in FIG. 4A. In this embodiment, liner bag 51 and support bag 52 have separate edge seals. As shown in more detail in FIGS. 4A and 4C, top edges of liner bag 53, 53' are not attached to support bag sidewalls 58, 58' across the total longitudinal width of sidewalls 58, 58'. This attachment of liner bag 51 to support bag 52 creates openings 63 into support bag 52 adjacent liner bag edge seals ad and bc. The opening 63 into support bag 52 is open to the atmosphere when closure 14 is open. The liner bag 51 may be attached to support bag 52 along liner bag top edges 53, 53' by attaching means described hereinbefore.

Figure 5A:
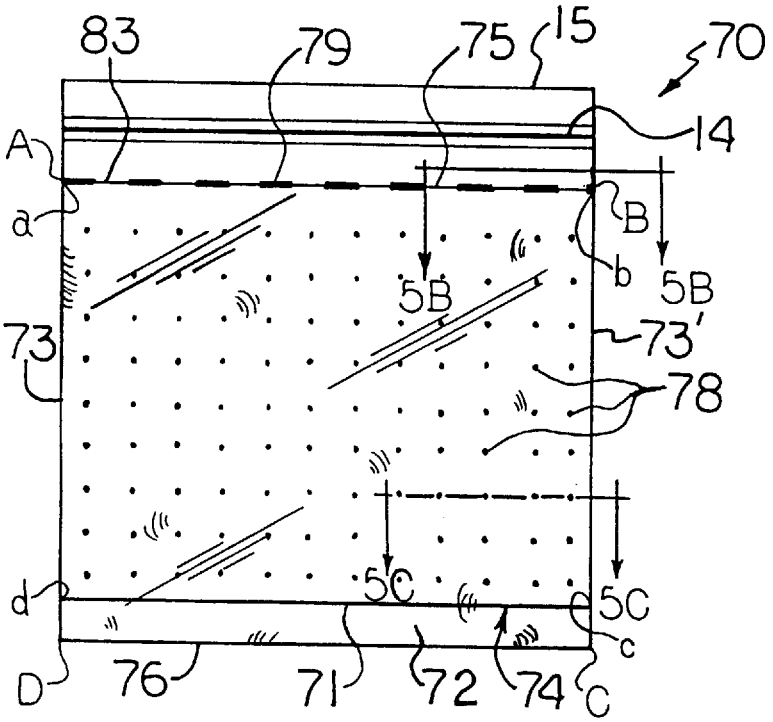
FIG. 5A is a front elevational view of a 3-layer multibag of the present invention having an inner film layer between the liner bag and the support bag, wherein the liner bag has microholes throughout its surface.
Figure 5B:
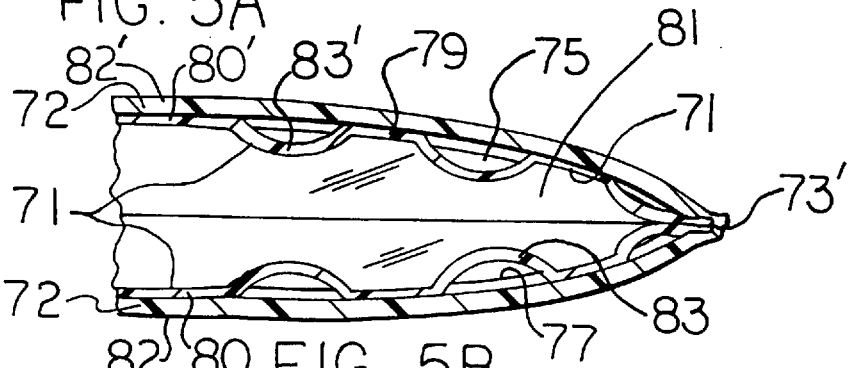
FIG. 5B is a partial cross-sectional view along line 5B—5B of FIG. 5A.
Figure 5C:
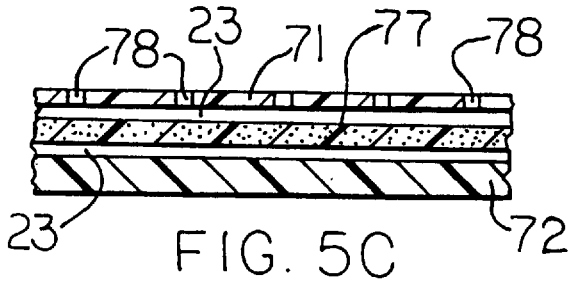
FIG. 5C is a partial cross-sectional view along line 5C—5C of FIG. 5A showing an optional third inner layer between liner bag and support bag of FIG. 5A.

Another embodiment of a multibag of the present invention is shown in multibag 70 of FIG. 5A and in FIGS. 5B–5C. Multibag 70 comprises generally liner bag 71 and support bag 72 having a reusable closure means 14. Liner bag 71 is defined by edge seals shown by lines ad and bc joining sidewalls 80, 80' (FIG. 5B) and has folded edge 74. Support bag is defined generally by edge seals 73, 73' (FIG. 5B) joining sidewalls 82, 82' and has folded edge 76. Viewing FIGS. 5A and 5C, liner bag 71 has a plurality of microholes 78 (described below) through sidewalls 80, 80'. Referring to FIG. 5B, top edges of liner bag 83, 83' are heat sealed intermittently across the longitudinal length of sidewalls 82, 82' forming holes 75 and attached areas 79. Top edges of liner bag 83, 83' attached to support bag sidewalls 82, 82' defines opening 81 to liner bag. Referring to FIG. 5C, multibag 70 has an inner film layer 77 sandwiched in between liner bag 71 and support bag 72.

Holes 75 and sealed areas 79 are formed from intermittent heat sealing of liner bag top edges 83, 83' to support bag sidewalls 82, 82'. Holes 75 are the areas of liner bag top edges 83, 83' that are not attached to support bag sidewalls 82, 82'. In this embodiment of the present invention, the top edges of liner bag 83, 83' are heat sealed intermittently to support bag sidewalls 82, 82' where portions of inner layer 77 have been removed. In this embodiment, inner film layer 77 is made of a material for example, that is not heat sealable to either liner bag or support bag. However, liner bag may be attached to support bag with an intermittent seal in any embodiment of the present invention. A discontinuous or intermittent attachment or seal of a liner bag to a support bag may also be made using conventional adhesives, hot melt adhesives, or hot air hem sealing or other sealing means described hereinbefore as is know in the art.

Holes 75 open to the inside of the support bag and to the atmosphere when closure means 14 is open, to allow the user to remove air from in between the liner bag and the support bag so to enhance the cling of the liner bag to the meat. Holes 75 are only along the point of attachment of the liner bag to the support bag. Holes 75 perform essentially the same function as vent holes 99 but are typically much larger than vent holes 99 and microholes 78.

Microholes 78 are generally uniformly distributed across the entire surface of at least one sidewall of a bag. Vent holes, on the other hand, are not generally uniformly distributed across the entire surface of at least one sidewall of a bag. Microholes 78 are distinguishable between vent holes 99 in that vent holes 99 are few in comparison to the number of microholes that would be present in a sidewall of a bag. Normally, a multibag of the present invention would not have both microholes and vent holes since the microholes would permit air to escape as well as allow water to permeate through from the meat to the inner film layer. Both the support bag and the liner bag may have microholes through respective sidewalls. Preferably, only the liner bag of the multibag shown in FIGS. 5A–5C has microholes.

In practice, foodstuffs such as meat would be placed into multibag 70 and the meat would contact the liner bag 71. Water would permeate through microholes 78 of liner bag 71 and the water would be adsorbed by hydroscopic inner film layer 77 and the inner layer 77 would swell slightly causing the liner bag 71 to uniformly contact the meat's surface. Uniform contact of the liner bag with meat prevents the meat from being freezer burned.

By "uniformly distributed" it is meant that the microholes are substantially identically and substantially evenly spaced apart from each other over the entire surface area of a sidewall or film web. The microholes are preferably in a polka-dot like matrix or pattern. Generally, the microholes have a diameter of from about 50 to about 950 microns, preferably have a diameter of from about 100 to about 500 microns and more preferably have a diameter of from about 200 to about 300 microns. Generally, the number of microholes per until area is from about 3 microholes/in$^2$ to about 81 microholes/in$^2$. Preferably, the hole density is from about 5 microholes/in$^2$ to about 50 microholes/in$^2$ and more preferably from about 8 to about 30 microholes/in$^2$. A process and apparatus for microperforating films are described in U.S. Pat. No. 5,405,561 incorporated herein by reference.

Generally, a third layer or inner film layer 77 may be made of the same or different materials than those used to make the liner and support bags. Useful materials include thermoplastic polymers, cellulosic polymers, paper, cotton, polyvinyl alcohol, a plastic fiber matrix such as TYVEX™ (available from DuPont), a polyester fabric such as RAYON™ or DACRON™, an elastic fabric such as LYCRA™, or a generally hygroscopic material in the form of a film. Preferably, inner film layer 77 is film of a hygroscopic material, for example a cellulose ether or a polyvinyl alcohol. More preferably, the inner film layer is a film made from a hydroxypropyl methyl cellulose resin such as METHOCEL, (Trademark of The Dow Chemical Company) available from Polymer Films, Inc., Rockville, CT.

Figure 9A:
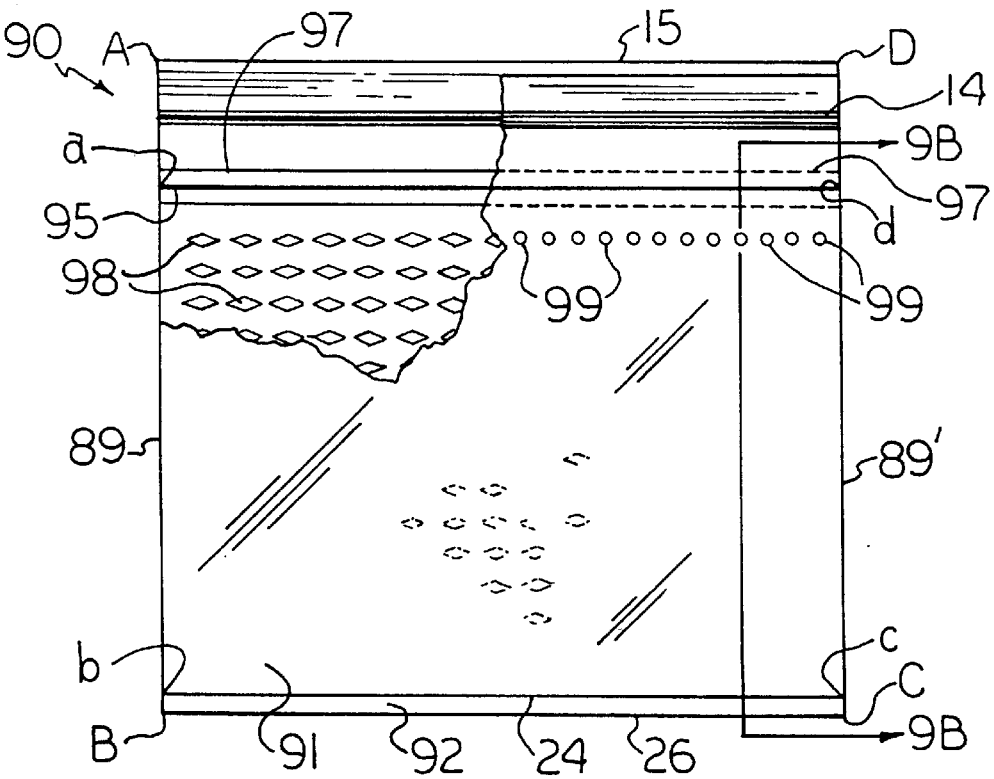
FIG. 9A is a front elevational view of a double wall bag in accordance with the present invention, having a liner bag prepared from a textured, particularly embossed film on at least the inside surface.
Figure 9B:
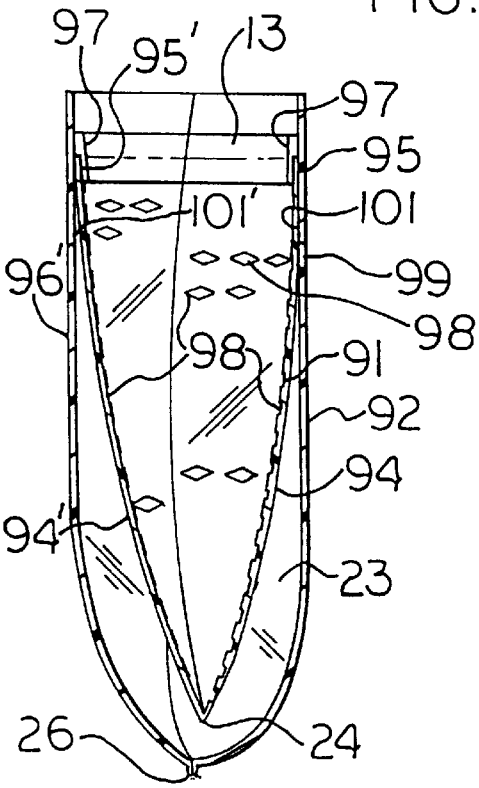
FIG. 9B is a cross sectional view taken along reference line 9B—9B of FIG. 9A.

A preferred embodiment of a multibag of the present invention is shown in multibag 90 of FIG. 9A. Multibag 90 is comprised of a liner bag 91 and a support bag 92 having a reusable closure means 14. Liner bag 91 is defined by edge seals ad and bc and a folded edge 24. Support bag 92 is defined by edge seals 89, 89' and folded edge 26. Liner bag 91 and support bag 92 share edge seals ad and bc. Referring to FIGS. 9A and 9B, top edges 95, 95' of liner bag 91 are attached to sidewalls 96, 96' of support bag 92 longitudinally across inside surfaces 101, 101' by a blanket seal 97 in the machine direction. Top edges 95, 95' attached to support bag sidewalls 96, 96' define the liner bag opening. Liner bag sidewalls 94, 94' and support bag sidewalls 96, 96' are generally separable except at edge seals ad, bc and blanket seal 97 (described hereinafter) forming a space 23 therebetween as shown in FIG. 9B. Support bag 92 has a plurality of vent holes 99 through its sidewall 96 below blanket seal 97. Liner bag 92 has textured inner surfaces 98 as shown in FIGS. 9A and 9B. Preferably, the textured surfaces 98 are embossed. Vent holes 99 may also be through a liner bag sidewall 94, 94' below blanket seal 97.

Figure 9C:
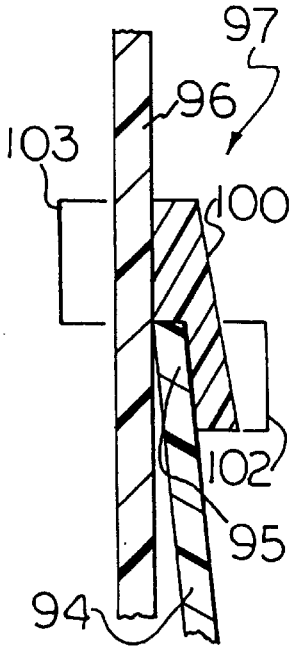
FIG. 9C is an enlarged cross sectional view of a blanket seal for attaching the top edges of the liner bag to the sidewalls of the support bag.

As shown more particularly in FIG. 9C, a hinge-type blanket seal 97 is formed by overlaying a sealing band 100 of extruded material over the top edges of the liner bag 95 in the machine direction of the liner bag and support bag film. The process of applying a sealing band and forming a blanket seal is described hereinafter. The sealing band 100 is attached to the support bag sidewalls generally at area 103 and is attached to the liner bag to edges generally at area 102. The top edges of the liner bag are not heat sealed to the support bag sidewalls in this embodiment. Attaching sealing band 100 to both sidewall 96 and top edge 95 creates a hinge-like attachment whereby top edge may be pulled away from sidewall 96 and form a T-shape at the point of attachment. The strength of the attachment of the sealing band to the support bag and the liner bag is preferably such that the liner bag film will fail during a T-shape pull test. The sealing band 100 used to form a hinge-type blanket seal may be made from any suitable thermoplastic material or combination of thermoplastic materials that are heat sealable to at least the portions of the thermoplastic films to be joined. Preferably, the sealing band is polyethylene and more preferably, low density polyethylene or other materials which are compatible with the support and liner bag materials hereinafter described.

Figure 9D:
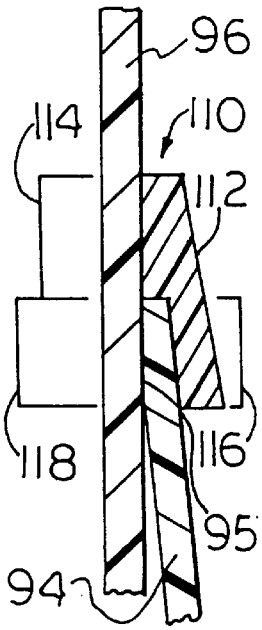
FIG. 9D is an enlarged cross sectional view of another embodiment of a blanket seal for attaching the top edges of the liner bag to the sidewalls of the support bag.

Another type of blanket seal useful in the present invention is a blanket seal which attaches to both the support and liner bag materials and also causes the liner bag material to heat seal to the support bag. As shown in FIG. 9D, heat seal type blanket seal 110 comprises sealing band 112 applied over the top edges of the liner bag 95 and contacting support bag 96 and being attached generally at areas 114 and 116. The liner bag top edge 95 is heat sealed and rigidly attached to the support bag 96 generally at area 118. The heat seal type blanket seal is formed when the sealing band can transfer enough heat through the liner bag film to cause it to heat seal to the support bag film. A sufficient amount of heat transfer from the sealing band is transferred if the sealing band temperature, heat capacity, and mass are sufficiently high, and the liner bag film is sufficiently thin and has a sufficiently low sealing temperature. Sealing band 112 may be made of the same materials described hereinbefore as useful for sealing band 100. The support and liner bag materials as hereinafter described must be heat sealable to each other in order to form a heat seal type blanket seal.

Surprisingly, by texturing or embossing the film of the liner bag, the liner bag film has improved performance. The improved performance of the embossed liner bag film is attributed to an increased surface area of the film which provides greater cling to a meat surface than an unembossed liner. Embossing also effectively reduces the overall stiffness of the film which also improves cling of the liner bag film to the meat surface.

Figure 11:
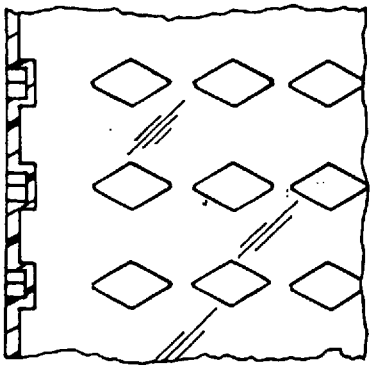
FIGS. 11–16 are enlarged cross sectional and plan views of various preferred embossing patterns for embossing the either or both liner bag surfaces.
Figure 12:
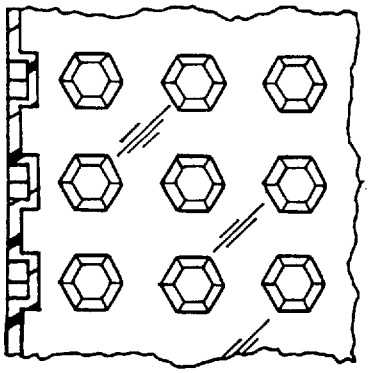
Figure 13:
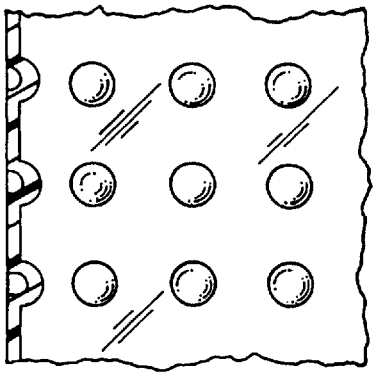
Figure 14:
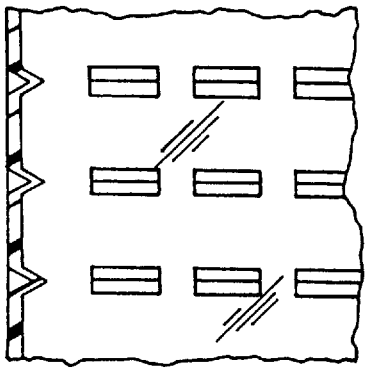
Figure 15:
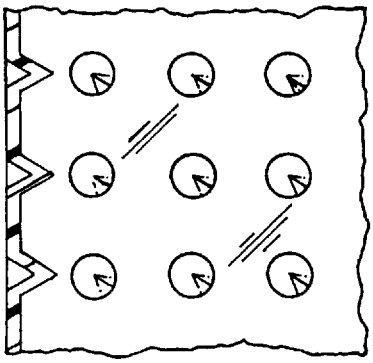
Figure 16:
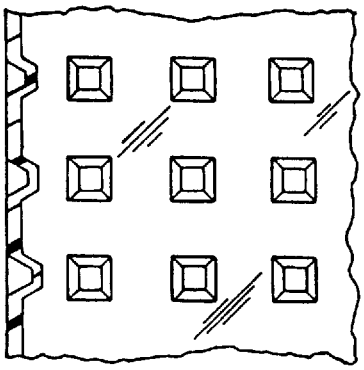

Generally, any embossed pattern may be used on the liner bag or on the support bag. Useful embossing patterns and shapes include for example elongated diamonds (FIG. 11), honey-combs (FIG. 12), squares, spheres (FIG. 13), triangles (FIG. 14), cones (FIG. 15), pyramids (FIG. 16) and the like. Uniform, discrete geometric patterns also provide channeling of air during the expellation of air from between the film layers. Other embossed patterns useful in the present invention and their manufacture are described in U.S. Pat. No. 5,113,555 incorporated herein by reference. Preferably, the embossed pattern on the liner bag is an elongated diamond and more preferably is a square or uniform shaped diamond which has a pyramid shape in cross section. Preferably, embossed patterns protrude from the inner surface of the liner bag so to contact meat or other foodstuffs. Generally, the density of the embossed elements that make up the pattern on the liner bag may be from about 6 to about 50 units per linear inch of the surface of liner bag, and preferably from about 10 to about 20 units per linear inch of the surface of liner bag.

Generally, the support bag and liner bag of the multibags of the present invention are made from a thermoplastic material or a blend of thermoplastic materials and can be comprised of the same or different material. The films may be made by a conventional cast or blown film process. Useful thermoplastics include for example polyolefins such as high density polyethylene (HDPE), low density polyethylene (LDPE), linear low density polyethylene (LLDPE), and polypropylene (PP); thermoplastic elastomers such as styrenic block copolymers, polyolefin blends, elastomeric alloys, thermoplastic polyurethanes, thermoplastic copolyesters, and thermoplastic polyamides; polymers and copolymers of polyvinyl chloride (PVC), polyvinylidene chloride (PVDC) , saran polymers, ethylene/vinyl acetate copolymers, cellulose acetates, polyethylene terephthalate (PET), ionomer (Surlyn), polystyrene, polycarbonates, styrene acrylonitrile, aromatic polyesters, linear polyesters, thermoplastic polyvinyl alcohols and useful materials listed hereinbefore that may be used to make an inner film layer. Preferably, the support bag and the liner bag are both made of polyethylene and more preferably from a blend of low density polyethylene (LDPE) (about 0.92 density) and linear low density polyethylene (LLDPE) (about 0.925 density). Preferably, the liner bag film has a density of less than 0.930 g/cc.

Generally, the film of the liner bag of the multibags of the present invention have a Transverse Direction 2 Percent Secant Modulus (TDSM) of less than 40,000 pounds per square inch (psi) ($2.75\times10^8$ Pa), and preferably less than 27,000 psi ($1.86\times10^8$ Pa) as determined in accordance with ASTM D 832-83, Method A with a jaw gap of 4 inches, a specimen width of 1 inch, an initial strain rate of 0.25 inches/inch/minute, and a crosshead speed of 1 inch/minute. The modulus of a film in either the transverse or machine direction of the film is generally a measurement of the stiffness of the film. Typically, thermoplastic polyolefin films that are prepared by cast film processes that are known in the art have a TDSM of less than 27,000 psi. Thermoplastic polyolefin films that are prepared by well known blown-film processes have a TDSM of from about 20,000 to about 40,000 psi. Examples of commercially available resins that would result in cast or blown films having these tensile properties include, for example, LDPE 748 and LDPE 690 from The Dow Chemical Company.

Another useful characteristic of the film of the liner bag is the Z number. The Z number is defined by the formula:

$$t^3\times TDSM$$

where t is the thickness of the film in mils and TDSM is the transverse direction modulus as defined above. The Z number describes the relative stiffness of the film as a function of the film's thickness and modulus. Generally, the liner bag film has a Z number of less than 60,000 $mil^3$ psi. Preferably, the liner bag film has a Z number of less than 20,000 $mil^3$ psi, more preferably from about 2,000 to about 10,000 $mil^3$ psi, and even more preferably, from about 3,000 to about 6,000 $mil^3$ psi.

Preferably, the support bag has a Z value in a range of from about 50,000 to about 150,000 $mil^3$ psi (5.6 to 16.9 $mm^3$.kPa).

Generally, the support bag will have a nominal sidewall thickness of from about 1 to about 4 mils, preferably from about 1.3 to about 3.0 mils, and more preferably from about 1.5 to about 2.0 mils. Nominal thickness refers to the thickness of the film prior to any surface treatment such as scoring, texturing, embossing, and the like.

Generally, the liner bag will have a nominal sidewall thickness of from about 0.3 to about 1.0 mil and preferably has a nominal sidewall thickness of from about 0.5 to about 0.7 mil.

Preferably, the inner surface of the liner bag has a contact angle in the range of from 65° to 75° at 20° C. relative to raw beef meat juice as determined by advancing contact angle determination using a contact goniometer for example Model No. A-100 available from Rame-Hart. Contact angle is defined as the angle formed between a horizontal substrate and a line tangent to the surface of a drop of liquid at the point where the surface of the liquid drop meet the horizontal substrate. The contact angle is a function of the surface tension of the liquid. The lower degree of contact angle indicates a higher degree of wetting or adhesion of the liquid to the substrate.

The method of measuring the contact angle is as follows: 1. Drops of the liquid to be measured (about 1 microliter) are place on the measuring surface (liner bag film) of the contact goniometer. 2. The contact angles are measured on both sides of each of five drops. 3. Step two is repeated on different sections of the liner bag surface and the results are averaged to determine a mean contact angle. Examples of film that have a contact angle of between 65° to 75° at 20° C. relative to raw beef meat juice include a blend of LDPE and LLDPE available from The Dow Chemical Company.

The multibags of the present invention may also have one or more layers of film or substrate between the support bag and the liner bag. Useful films and substrates include those materials listed above for the liner bag and the support bag and also include papers, cellulose polymers, fabrics, elastic fabrics and the like.

The multibags of the present invention may also be made of films having different colors so to highlight the bag-in-a-bag structure to the consumer. For example, the liner bag and support bag may be of a different color or tint or each or both may be opaque or clear.

The multibags of the present invention may also contain a liner bag and/or a support bag that comprises a film or substrate that has been corona treated to improve the wetting characteristic of the film and thereby improve the meat adhering and/or printing characteristic of the film. Preferably, the inside surface or food contacting surface of the liner bag is corona treated. Useful teachings describing the process of corona treating plastic films are described in U.S. Pat. No. 5,328,705 incorporated herein by reference.

The multibags of the present invention may also have a printed area on the support and/or the liner bag. Printed areas are used as a write-on surface or a write-on patch to record information relating to the contents of the bag. The write-on surface may also be strategically placed on the support and/or liner bag to hide vent holes.

The multibags of the present invention may also have a liner bag and/or a support bag that is pleated.

While not bound by any particular theory, it is believed that the means by which the multibags of the present invention prevent freezer burn of meats is that a thin, inner layer of film in the form of a bag which clings and conforms to the surface of the meat and therefore prevents moisture loss and excludes air from the meat surface. Excluding moisture loss and air from the meat surface reduces the formation of ice crystals that lead to freezer burn or dehydration of the meat.

Figure 7:
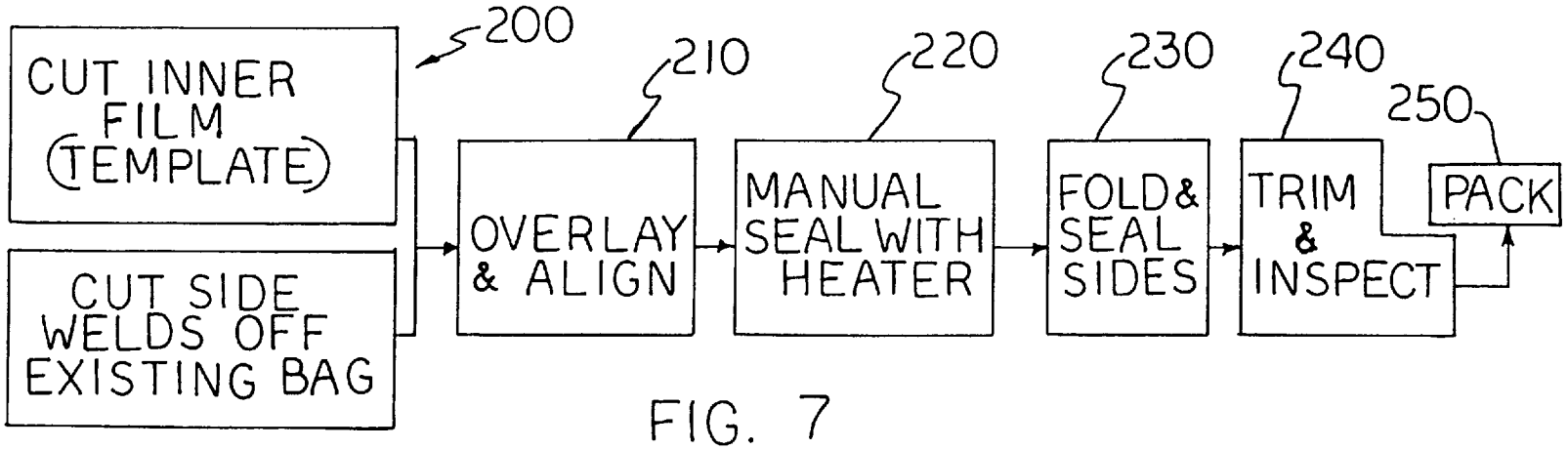
FIG. 7 is a diagrammatic flow diagram for one manual process of the present invention for making experimental freezer bags.

FIG. 7 shows a block diagram of a process for hand making the multibags of the present invention. As described in step illustrated by box 200, an inner liner film of polyethylene is cut to size and the edge seals of an existing polyethylene freezer bag are cut off and the freezer bag is unfolded. In step illustrated by box 210, the liner film is overlayed onto the unfolded freezer bag and aligned such that the edges of the liner film are between the closure profiles of the freezer bag. In step illustrated by box 220, the liner film is attached to the freezer bag film with a bar type heat sealer thereby heat sealing the two films together along the parallel edges of the liner film. In step illustrated by box 230, the attached films are folded such that the closure profiles are matched and the edges of the films are sealed to make a multibag. The sealed edges are formed by conventional heat sealing. In step illustrated by box 240, the excess thermoplastic is trimmed and the bag is inspected for integrity. The bag or bags are then packed in a dispenser as shown in step illustrated by box 250.

A process according to the present invention for making a multibag having at least an inner liner bag and an outer support bag generally comprises the steps of forwarding a first thermoplastic film web having a thickness of greater than 1 mil and a first transverse web width between parallel edges, forwarding at least a second thermoplastic film web having a thickness of less than 2 mil and a second transverse web width, the second transverse web width being smaller than the width of the first thermoplastic film, overlaying the second thermoplastic film web onto the first thermoplastic film web between the parallel edges of the first film web, attaching the second thermoplastic film to the first thermoplastic film along parallel edges of the second thermoplastic film, folding the films in the transverse direction, and seal cutting the folded films to form bags.

Figure 8:
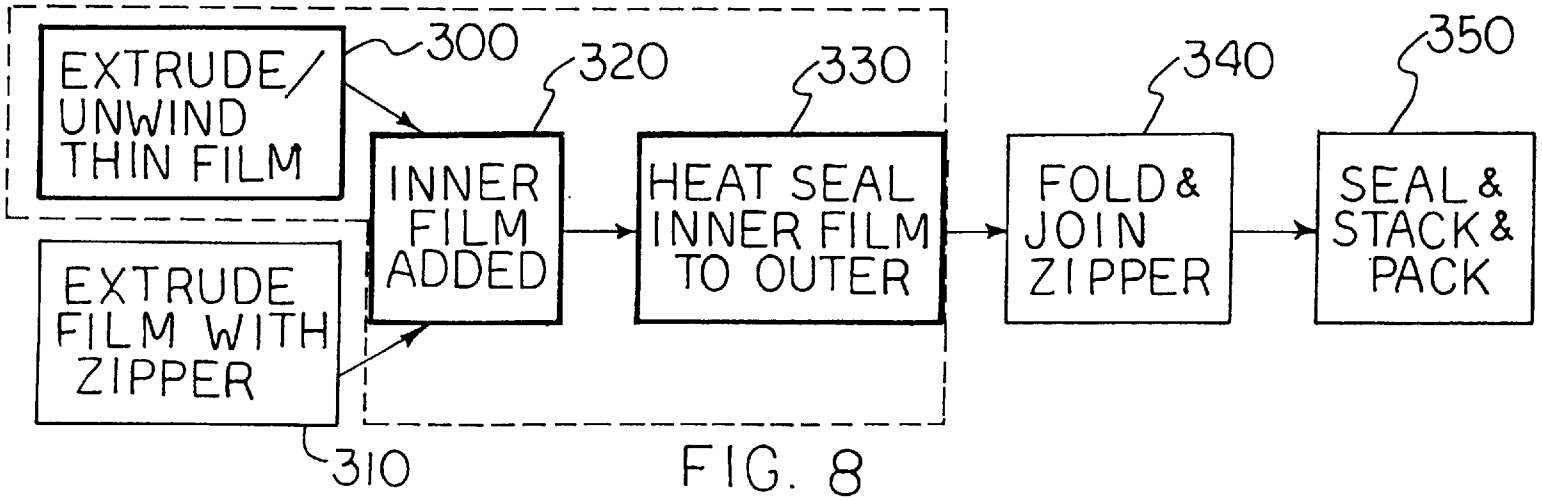
FIG. 8 is a diagrammatic flow diagram for a process of the present invention for making freezer bags having a common edge seal between the liner bag and support bag.

FIG. 8 is a diagrammatic flow diagram for one embodiment of the process of the present invention. As shown in step illustrated by box 300, the liner film or second film may be extruded or supplied from an unwind stand. Extrusion of the liner film may be by blown or cast extrusion of thermoplastic material as is known in the art. Step illustrated by box 310 provides that the support or first thermoplastic film is extruded having zipper type closure profiles on each respective film edge. The extrusion may be either conventional cast or blown film. An example of an integral cast film process is described in U.S. Pat. No. 4,263,079 incorporated herein by reference. Preferably, both of the films are cast extruded. In step illustrated by box 320, the inner or second film is added or overlayed onto the first film. The second film is aligned such that the edges of the second film are between the closure profiles of the first film. The overlaying and alignment of the second film onto the first film is done using conventional guide means such as rollers and nip rolls. In step illustrated by box 330, the parallel edges of the liner or second film are heat sealed to the support or first film. The films may be heat sealed together using conventional heat sealing means such as a heated bar sealer, a hot air hem sealer, extrusion lamination, heated rollers and belts and the like. Preferably, the films are sealed together by a hinge-type blanket seal. The process step for forming a blanket seal is described hereinafter. In step illustrated by box 340, the attached films web is folded and the closure profiles are joined. The web may be folded by conventional folding means known in the art. In step illustrated by box 350, the the folded film web is seal cut to form bags, the bags are stacked, and the stacked bags are packed into a container. The attached films may be folded and seal cut into bags as described in U.S. Pat. No. 5,062,825, incorporated herein by reference. Preferably, the male and female closure elements are interlocked after folding of the films and prior to seal cutting. The finished bags may be stacked, delivered, and then packed into containers as described in U.S. Pat. No. 5,302,080, U.S. Pat. No. 5,108,085 and U.S. Pat. No. 5,185,987, incorporated herein by reference. The process of the present invention for making a multibag of at least two bags contemplates attaching together more than two film webs.

Either one or both of the first and second films my be textured by for example embossing. Either or both of the film webs may be corona treated prior to or after being attached together. Preferably, the second thermoplastic film is corona treated and embossed prior to overlaying the second film onto the first thermoplastic film.

The second or liner film web may be microperforated prior to being overlayed onto the first or support film web using a process and an apparatus described in U.S. Pat. No. 5,405,561.

Vent holes 99 may be placed in either or both of the film webs using any film puncturing means or method known in the art such as a process and apparatus similar to the process and apparatus described in U.S. Pat. No. 5,405,561. Vent holes may also be made in either or both film webs using a laser or a puncturing means having pins protruding from a rubber roller. Preferably, vent holes 99 in the film are made by perforating the film with a non-heated perforating means. Preferably, at least one vent hole 99 is placed in the support or first thermoplastic film web below the seal attaching the film webs prior to overlaying the films. The vent hole 99 in the support film web prevents air becoming trapped between the webs and forming a bubble or wrinkling the film when passing through compression rolls or during folding of the web.

Preferably, the closure profiles on the first thermoplastic film are formed and applied after the film webs are attached together. The closure profiles may be extruded through a die to form the desired profile and then applied to the film post-extrusion as is known in the art. An example of an extrusion and post-application process of closure profiles is described in U.S. Pat. No. 5,049,223, incorporated herein by reference.

Figure 10:
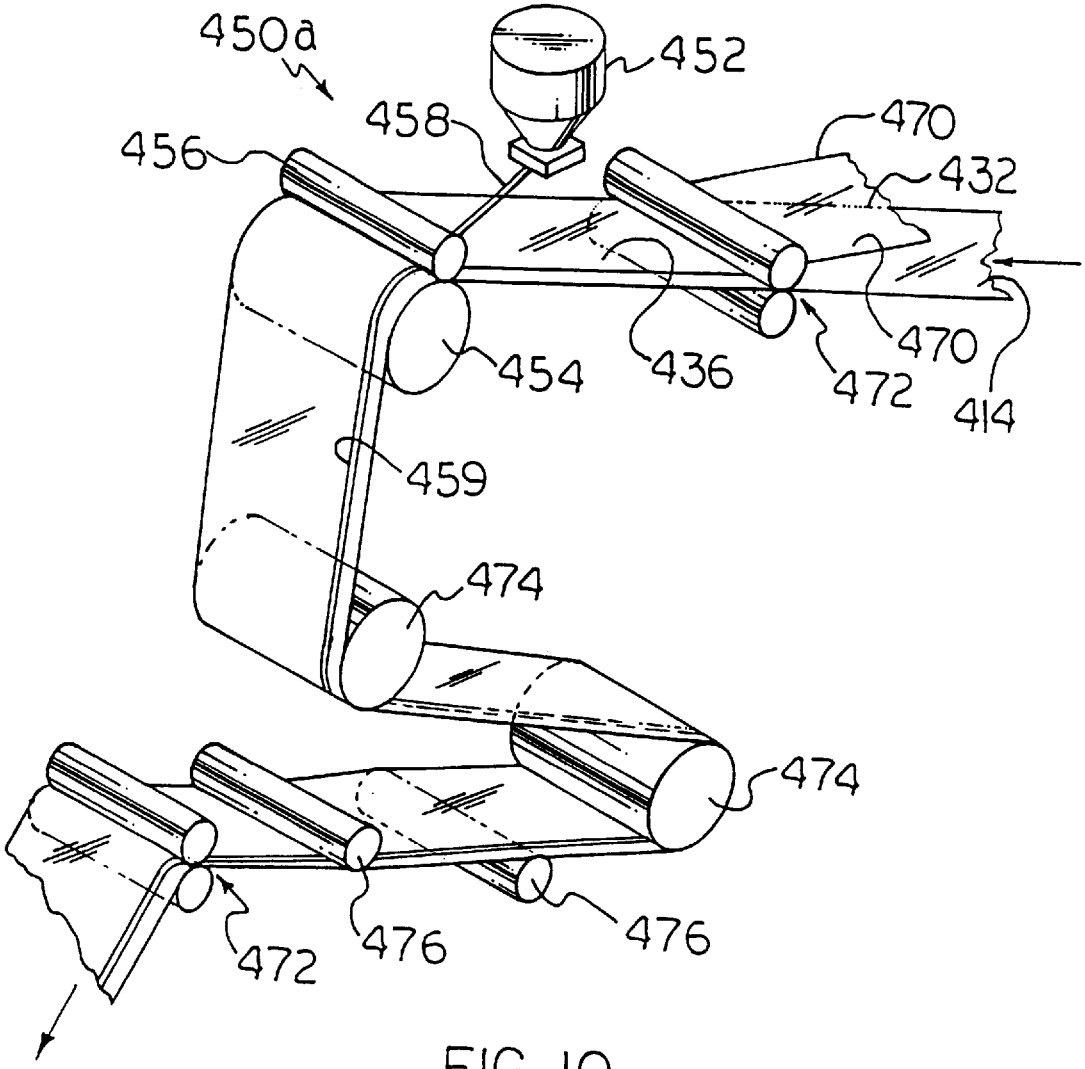
FIG. 10 is an isometric view of one process for preparing and blanket sealing bags of the present invention.
Figure 17:
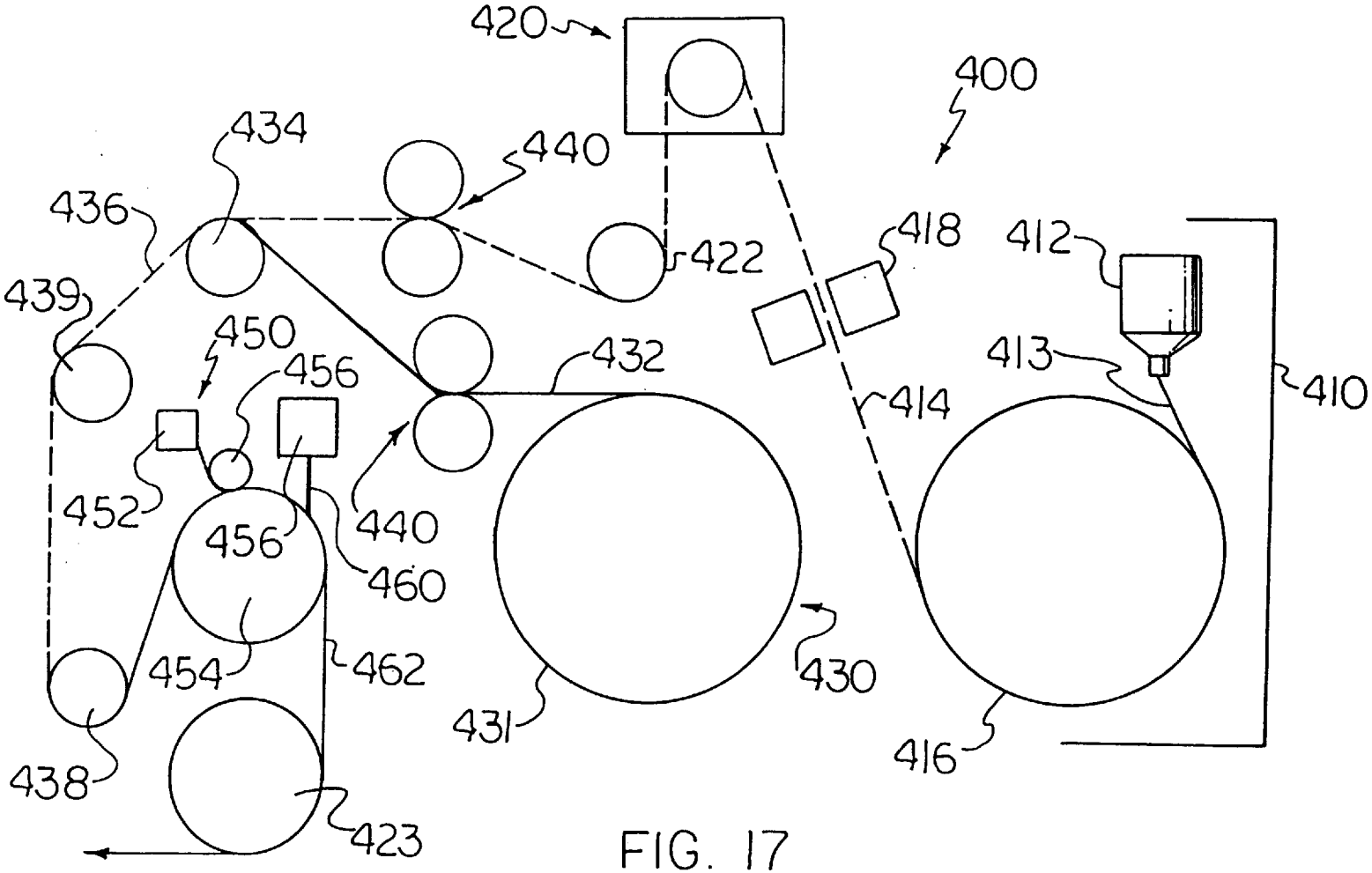
FIG. 17 is a cross sectional view of a preferred process of making the bags of the present invention.

A preferred process for making the film web used for making multibags of the present invention is shown in FIG. 17 and a process for attaching the two film webs is shown in FIG. 10. FIG. 17 is a schematic side view of the process providing and attaching film webs 400 and FIG. 10 is an isometric view of a process for attaching the film webs together prior to forming bags. Referring to FIG. 17, process 400 generally comprises a means for providing a support or first film web 410, a means for providing a liner or second film web 430, tension control means 440 and a sealing or attaching means shown generally as 450. Means 410 generally comprises an extrusion means 412 in extrusion alignment with a cast roll 416. Extrusion means 412 extrudes a thermoplastic material 413 onto cast roll 416 to form a support or first film web 414. The means for providing the first film web may also be any means known in the art and may be an extrusion process as described in U.S. Pat. No. 5,049,223. Film web 414 passes through a conventional gauge control means 418 to a corona treatment means 420 wherein the first film web 414 is corona treated as described hereinbefore, to prepare the film for later optional printing.

A liner or second film web 432 is provided by a roll or unwind stand 431. The second film 432 may also be provided by a conventional blown or cast film process as is know in the art. The second film web has a transverse web width that is smaller than the transverse web width of the first film web 414. Film webs 414 and 432 are fed in to tension control means such as nip rolls 440 so as to match the strain of each of the films. Matching the strain of the films is described hereinafter in more detail. The first and second film webs 414 and 432 are aligned and overlayed at roll 434 forming web 436. Web 436 is fed into a sealing means shown generally as 450. Web 436 changes orientation at roll 438 and is fed into sealing means 450. Sealing means 450 generally comprises an extrusion means or extruder 452, roll 454 and compression roll 456. A preferred sealing means is shown in FIG. 10 and described below. Extruder 452 provides a sealing band 458. Sealing band 458 is fed onto web 436 and overlaps the parallel edge of liner or second film 432. The sealing band 458 on web 436 passes between roll 454 and compression roll 456 and forming a blanket seal. Extrusion means or extruder 456 provides closure profiles 460. Closure profiles 460 are attached to the opposed parallel edges of the first film 414 as described in for example U.S. Pat. No. 5,049,223 forming a web having a blanket seal and closure profiles, web 462. Web 462 having closure profiles is then folded, sealed and cut, stacked, and packed as shown and described in FIG. 8.

Either or both of the film webs may be textured or corona treated as described hereinbefore. Either or both of the film webs may be microperforated or have vent holes placed therein as described above.

The second thermoplastic film or liner film may be attached to the first thermoplastic film or support film by means of an extruded blanket seal (overlaps edge of liner film) as earlier described with respect to FIGS. 9C and 9D, hot air hem sealing, extrusion lamination (extruded thermoplastic film between the film layers), hot melt adhesive (placed over or under the edge of the top film layer), ultrasonic sealing, heated rollers or belts, adhesive film strips, infrared sealing, radio frequency sealing, or vibration welding. Use of any of the above means of attaching two film webs largely depends on the chemical and physical characteristics of the film webs. Preferably, the liner film is attached to the support film using an extruded hinge-type blanket seal 97 as shown in FIG. 9C and hereinafter described. The process shown in FIG. 17 may be a continuous process or a step process. Preferably, the process is continuous.

FIG. 10 shows a process for attaching the second thermoplastic film web 432 to the first thermoplastic film web 414 and is indicated generally as process 450a. Referring to FIG. 10, in attaching a second thermoplastic film web 432 to a first thermoplastic film web 414 along parallel edges 470 of the second thermoplastic film web according to the present invention, the second thermoplastic film web 432 is aligned with and overlayed onto a first thermoplastic film web 414 forming film web 436. The film webs pass between nip rolls 472 and pass under a sealing band extruder 452. A sealing band 458 of molten thermoplastic material is extruded onto the advancing webs in the machine direction so as to overlap the edge 470 of the second film web and thereby contact and attach to both film webs securing the films together. The attached film webs are fed through a set of compression or pinch rolls 454, 456 forming a blanket seal 459. A conventional second sealing band extruder (not shown) is used to seal the opposite parallel edge of the second film web to the first film web. Film web 436 having a blanket seal 459 then passes through conventional guide rolls 474 and 476 so to orient the web 436 for folding and seal cutting to form bags.

The blanket seal 459 may be either a hinge-type blanket seal 97 (FIG. 9C) or a heat seal type blanket seal 110 (FIG. 9D). Preferably, the blanket seal 459 is hinge-type. Some of the advantages of the blanket sealing process include films may be attached continuously at a relatively high process rate, the blanket seal appears strong and aesthetically pleasing to consumers, the process is insensitive to other process variations, and it does not produce a film tail as does other processes known in the art.

Generally, the sealing bands may be applied in any fashion so as to attach the two films together. Preferably, the first thermoplastic film has mateable male and female closure elements along opposing edges of the film web and the sealing bands are applied equidistant from their respective closure profiles. More preferably, the sealing bands are applied equidistant from the respective edges of the first thermoplastic film such that mateable male and female closure elements may be applied to the support or first thermoplastic film after the film webs are attached.

Generally, the sealing band may be made from any suitable thermoplastic material or combination of thermoplastic materials that are heat sealable to at least the portions of the thermoplastic films to be joined. Preferably, the sealing band is polyethylene and more preferably, low density polyethylene. An example of a suitable commercially available LDPE useful in the present invention is LDPE 748, commercially available from The Dow Chemical Company.

When forming a hinge-type blanket seal, the width of the sealing band may generally range from about 3 mm to the width of the support or first film web. Preferably the width of the sealing band ranges from about about 3 to about 76 mm, and more preferably has a width of from about 6 to about 19 mm.

Generally, the sealing band used to form a hinge-type blanket seal has a thickness of from about 13 to about 254 microns (0.5 to 10 mils) and preferably has a thickness of from about 25 to about 51 microns (1 to 2 mils) and more preferably from about 25.5 microns to about 38.2 microns (1.0 to 1.5 mils).

The sealing bands may be tinted, colored, or textured so to highlight the bag-in-a-bag structure to the consumer.

Since the sealing band normally does not heat seal the second film to the first films the sealing band may advantageously be used to attach films that otherwise could not be heat sealed together. However, if the sealing band temperature, heat capacity, and mass are sufficient, and the liner film has an appropriate thickness and sealing temperature, the extruded sealing band will transfer enough heat through the liner film to heat seal it to the support film.

Generally, the width of the liner or second film web is less than or smaller than the width of the first film web so that any portion of the seal band does not hang over the edge of the first film web after being applied. Preferably, the width of the liner or second film is smaller than that of the width of the first film such that male and female closure profiles may be attached along opposed parallel edges of the first film web.

Generally, it is known in the art that to attach two webs together, it is desirable to match the % stretch, or strain, in the two webs at the point they are joined. Matching the strain avoids a cross direction curling (CD Curl) phenomenon from occurring when the tension is released. In the machine direction, the tension in each web can be related as follows:

In the elastic region, $$\acute{o} = E\epsilon = \frac{T}{t}$$

Where:
ó=Stress (psi)
E=Modulus of Elasticity (psi)
ϵ=Strain (in/in)
T=Tension (PLI)
t=Thickness (in)

Rearranging gives:

$$\epsilon = \frac{\acute{o}}{E} = \frac{T}{tE}$$

To avoid machine direction (MD) puckering when an inner liner film is attached to an outer film, $$\text{Set } \epsilon_{\text{Liner}} = \epsilon_{\text{Outer film}}$$

$$T_{Liner} = T_{Outer} \cdot \left[ \frac{t_{Liner} \cdot E_{Liner}}{t_{Outer} \cdot E_{Outer}} \right]$$

For elastic films, it is known in the art that a material under tension in the machine direction will contract or "Neck-in" in the cross direction as a function of a material property known as Poisson's ratio, v. Poisson's ratio is a ratio of lateral strain to axial strain and is typically about 0.3 for polyethylene. Using Poisson's ratio to relate the lateral strain to the axial strain, and following a similar derivation as above, the conditions required to match CD Strain and avoid MD Curl is as follows:

$$T_{Liner} = T_{Outer} \cdot \left[ \frac{\nu_{outer} \cdot t_{Liner} \cdot E_{Liner}}{\nu_{Liner} \cdot t_{Outer} \cdot E_{Outer}} \right]$$

In practice, it is generally desirable to match the strain in both the machine and cross directions. The puckering can be minimized by a variety of means, including: attaching webs that are similar in modulus and/or attaching webs that are similar in Poisson's ratio.

For a given set of materials, the puckering can be minimized by running at low tension where the films are attached, so there will be less recovery. Depending on the application, the cross direction puckering can sometimes be considered insignificant compared to the machine direction.

Thus it is desirable to maintain a relatively low tension in both webs, and have matched machine direction strain in the webs at the point where they are joined. It is generally known in the art that a recommended tension in the machine direction range to effectively transport webs is from 10–25% of the yield tension, measured in PLI. Film tracking may become less precise at tensions below 10% of the yield tension. While the MD tension in each web can be maintained from 0–100% of the yield point, it has been found that above 25% of the yield point, there is a danger of localized thin spots in the web actually exceeding the yield point of the film, resulting in non-elastic stretching. It has been found that for successful attachment of extruded sealing bands, the tension is preferably run in the range of 2–15% of the yield tension in the machine direction.

For the preferred embodiment, it has been found advantageous to use lightweight idler rolls with low friction bearings, to minimize the drag between the liner film supply point and the point where a blanket seal is applied. Even then, the tension in the liner film at the supply point is often so low that there becomes a trade-off between low enough tension to avoid puckering or stretching, and high enough tension to give adequate tracking. As a result, the embodiment shown in FIG. 10 has a set of nip rolls between the two web supply points and the point where a blanket seal is applied. Then the tension the two webs can be matched at somewhat higher, for example, 15% of the yield point tension, prior to the nip rolls. Nip rolls allow different tension control zones. The strain in the webs can be matched by appropriate tension control between the supply points and the nip roll. The compression roll is run at slightly lower speed that the nip rolls so to release some of the MD tension, reducing it to the desired 2–15% range for blanket band sealing. A second set of nip rolls could optionally be added such that each web would run through a separate nip, and could have separate tension control, just prior to joining of the separate film webs as shown in FIG. 17.

Referring back to the process shown in FIG. 17, the tension of the liner or second thermoplastic film is generally controlled in the range of from about 0.05 to about 1 pound per linear inch width (PLI) (0.6 mil PE) by using a set of compressing or nip rollers 440 as in known in the art. In the preferred embodiment, each of the film webs pass through nip rolls so to match the strain on each of the films. Thus, the tension of each of the film webs may be different in order to match the strain on each of the films. Alignment of the liner or second film may be accomplished by using conventional edge guiding systems and/or edge trimming of the film web to width.

Referring to FIG. 10, the tension of the combined films is generally controlled in the range of from about 0.02 to about 2.0 PLI (PE films) after the sealing band is applied to avoid stretching of the warm bands. The tension of the combined film webs may be controlled by conventional nip rollers 472. Stretching of the blanket bands may produce a "wave" and/or puckering in the final product.

An alternate process according to the present invention for heat sealing at least two film webs comprises the steps of providing at least first and second film webs capable of being heat sealed together, overlaying the second film web onto the first film web, providing at least one sealing band of material having a temperature, mass, and heat capacity sufficient to heat seal the second thermoplastic film to the first thermoplastic film, and applying said band of sealing material to the overlayed film webs. This process is the same as the process shown in FIG. 10, except that the sealing band extruder 452 may be placed above any portion of the film web 436 so to heat seal the film webs together in the machine direction at any point across the web. Preferably, the sealing band is compressed between rollers 454, 456 after having been applied. Multiple sealing band extruders 452 are used to provide multiple sealing bands 458 along the machine direction of the film web so as to form multiple heat seal type blanket bands as shown in FIG. 9D. The film webs may be provided by extrusion or from an unwind stand. The film webs to be heat sealed may be made of any thermoplastic materials capable of being heat sealed together including those materials described hereinbefore. The film webs may have the same width or be of different widths. Generally, the sealing band may be made of any extrudable material capable of heat sealing to film webs together. Preferably, the sealing band is made from thermoplastic materials including for example LDPE 748 available from The Dow Chemical Company.

Generally, the sealing band has a temperature, heat capacity, and mass sufficient to heat seal two films together. Generally, the temperature of the sealing band is the temperature at which the particular material may be extruded without degrading.

Generally, the thickness of the film to be heat sealed should of a thickness so to allow heat transfer from the sealing band to the film to heat seal the film to the underlying film web. Generally, the thickness of the sealing band used to form a heat seal type blanket seal may range from about 0.5 to about 10 mil. Preferably, the sealing band for a heat seal type blanket seal has a thickness of from about 1.5 to about 3.0 mil and more preferably has a thickness of from about 1.5 to about 2 mil.

Generally, the width of the sealing band used to form a heat seal type blanket seal ranges from about 3 mm to the width of the support or first film web, preferably the width of the sealing band ranges from about about 3 to about 76 mm, and more preferably has a width of from about 6 to about 19 mm.

Another process according to the present invention for attaching at least two film webs comprises the steps of providing at least first and second film webs having first and second widths respectively, the second width being smaller than the first width, overlaying the second film web onto the first film web between parallel edges of the first film web, providing at least one band of sealing material, and applying said band of sealing material along and over parallel edges of the second film web. Preferably, the sealing band 458 is applied to the film webs by one or more extruders 452 (FIG. 10). Extruders 452 may be placed at any point above the film webs so to be capable of attaching the film webs together by forming a hinge-type blanket seal in the machine direction. For example, multiple extruders 452 may be staggered above the parallel edges of three or more film webs so to attach the film webs together in succession. Preferably, the sealing band 452 is compressed between rollers 454, 456 after having been applied to the parallel edges of the film web or webs.

Preferably, the sealing bands 458 used to form hinge-type blanket seals are applied equidistant from the respective edges of the first thermoplastic film. Generally, the sealing band may be made from any suitable thermoplastic material or combination of thermoplastic materials that are heat sealable to at least the portions of the film webs to be joined. The film webs to be joined may be for example thermoplastic as described hereinbefore, non-thermoplastic, fabrics, nonwovens, coextruded films, and the like. The film substrates are attached together by the sealing band as shown in FIG. 9C.

When forming a hinge type blanket seal, the width of the sealing band may generally range from about 3 mm to the width of the support or first film web, preferably the width of the sealing band ranges from about about 3 to about 76 mm, and more preferably has a width of from about 6 to about 19 mm.

Generally, the sealing band used to form a hinge-type blanket seal has a thickness of from about 13 to about 254 microns (0.5 to 10 mils) and preferably has a thickness of from about 25 to about 51 microns (1 to 2 mils) and more preferably from about 25.5 microns to about 38.2 microns (1.0 to 1.5 mils).

EXAMPLES OF THE INVENTION

The experimental work that led to the aspects of the invention claimed hereinafter involved time-consuming hand fabrication of numerous different types of "multibag" defined above; repackaging of meat in the multibags; and evaluation of the performance of the multibags relative to each other and other controls being commercially available freezer bags, during and after many months of storage in a freezer.

The experimental work involved the sequential evaluation of three main types of prototype, types A, B, and C described below.

TYPE-A PROTOTYPES

Type-A prototypes were all three layer multibags made essentially in accordance with FIGS. 5A, 5B and 5C having a support bag, a liner bag, a third layer, and vent holes for venting the space between the liner bag and the support to the space within the liner bag.

More specifically, Type-A1 multibags were fabricated as follows:

a. A support bag being an outer layer of polyethylene film (used for making ZIPLOC® storage bag 1.75 mil);

b. A liner bag being an inner layer of polyethylene film 1.75 mil thick with 800 microholes having hole diameters of 10 microns as vent holes to permit moisture to move freely into and out of the middle layer; and c. A third layer being a hygroscopic film having a thickness of 1.5 mil and moisture content of around 10 percent by weight (METHOCEL® cellulose ethers film made by Polymer Films, Inc.-Rockville, CT). METHOCEL® is a registered trademark of The Dow Chemical Company. More specifically, typical properties of the film are found in the June, 1986 data sheet of Polymer Films Inc., for product named "EM IIDO Water Soluble Film". The product was identified as having the primary constituent being Hydroxypropyl Methyl Cellulose Resin having CAS No of 009004-65-3.

Further, it will be noted from FIG. 5A that the edge seals AD and BC of the support bag are essentially "common" with the edge seals ad and bc of the liner bag.

TYPE-B PROTOTYPES

Type-B prototypes were all three layer multibags essentially similar to the Type-A prototypes except that the liner bag had a thickness of 1.2 mil (instead of 1.75 mil); and except the liner bag had no microholes therein and that the space between the liner bag and the support bag was essentially completely unvented.

TYPE-C PROTOTYPES

Type-C prototypes were all multibags of the duplex variety as shown in FIGS. 2A, 2B, 2C, 3A, 3B, 3C, 4A, 4B and 4C and having a support bag having a thickness of 1.75 mil and a liner bag having a thickness of 0.6 mil without any "third layer or wall" between the liner bag and the support bag.

The Type-C multibags were given a secondary classification (denoted by the letter "C" or the letter "S" dependent upon whether the bags had "common edge seals" or "separate edge seals". The liner's edge seals are shown on the lines ad and bc in FIGS. 2A, 3A and 4A. The edge seals of the support bag are shown by the lines AD and BC in FIGS. 2A, 3A and 4A. Clearly, in FIG. 2A the edge seals are essentially "common"; whereas in FIGS. 3A and 4A the edge seals are "separate".

The bags were fabricated by hand. FIG. 7 is a diagrammatic flow diagram for making Type-CC multibags.

The Type-C multibags were given a tertiary classification (1, 2, or 3) according to whether the space between the support bag and the liner bag was (1) vented to the space within the liner bag (as shown in FIG. 4C); or (2) not vented (as shown in FIGS. 3A, 3B and 3C); or (3) vented to the surrounding atmosphere (as shown by the vent 99 in dotted line in FIGS. 2A and 2B).

EVALUATION PROCEDURE

All prototype multibags were essentially evaluated relative to control bags in the following way by actually using the bags as potential freezer bags containing boneless beef steak.

1. Beef steak samples were initially weighed before packing in the bags. Each bag had one beef steak. The bags were placed in a commercial freezer with a set point of 0° F.

2. The freezer was occasionally opened and closed for the purpose of observing the samples.

3. Physical observation (including bags conformation around steaks, formation of ice crystals, visible dry spots, and discoloration) were made daily during the first two weeks and then once every week for the next eight months for prototypes Type-A and Type-B. Type-C was physically observed over a period of three months. Frozen beef steaks were photographed in color both inside and outside the bags, then thawed and photographed again.

4. Percent weight loss and the amount of drips were measured on the thawed steaks. Amount of drips is defined as the blood-like fluid exuding from frozen meat upon thawing.

5. "Unexpected effects" were noted as appropriate.

SHORT TERM RESULTS—TYPES A, B AND C

Various Type-A prototypes and Type-B prototypes were evaluated simultaneously, and sequentially in a staggered manner.

Type-A1 described above was evaluated because the film was hygroscopic and in the hope that it might help to prevent moisture escaping from the meat during storage in the freezer.

However, an unexpected result occurred almost immediately. In particular it was discovered that with hygroscopic film layer between the liner bag and the support bag, the hygroscopic layer and the liner bag changed shape very rapidly and "conformed" to the shape of the beef steak. In other words it was highly beneficial in excluding air from the space around the beef steak.

It came as a second major surprise when the Type-B multibag also tightly conformed the liner bag around the steak as a short term phenomenon.

The apparent success of the Type-B multibag led to design of the Type-C multibag. Two types of Type-C bags were evaluated: Type-CC2 and Type-CS2. Again a surprisingly result occurred. The Type-CC2 multibag appears to conform more easily to the shape of the beef steak at packaging and "before" the beef steak package is placed in the freezer as shown in FIG. 6A. With hindsight, it is possible to make various speculations based upon the fact that the unvented bag essentially has constant mass of air between the liner bag and the support bag.

LONG TERM RESULTS—TYPES A AND B

Beef steaks in regular freezer bags (control) developed many large ice crystals and severe discoloration (bright red color faded into faint brown). Severe freezer burns as evidenced by large discolored dry spots, was observed on the steak in both frozen and thawed states.

Beef steaks in the Type-A three layer multibags (with a perforated inner layer) were in excellent condition. Formation of ice crystals was significantly reduced, the bright red color was maintained and no discoloration was observed. No freezer burn on the surface of the steaks was observed.

The Type-B three layer multibags with nonperforated film as the inner layer showed similar results to those obtained with Type-A multibags.

A key hindsight observation that may explain the significant difference in quality performance between the control bags and the three layer bags is that the middle and inner layers of the three layer bags had tightly conformed around the steak which resulted in reducing air pockets and subsequent formation of ice crystals.

A comparison of weight loss and amount of drips between treatments showed that weight loss of the steaks correlated well with the amount of formation of ice crystals. Beef steaks stored in regular freezer bags had a severe weight loss (20.5%) in eight months and the amount of drips was 2.06%. Beef steaks stored in the three layer bags (with a perforated inner layer) had a significantly less weight loss (4.3%) than the control and the amount of drips was 1.93%. The least amount of weight loss (1.9%) and drips (0.26%) was measured with steaks stored in the three layer bags (with nonperforated inner layer). The difference in performance between the three layer bags and control bags relate to the ability of the three layer bags to conform tightly around the meat, which led to minimizing air pockets. As a result of conforming, the dehydration process, that leads to freezer burn, was reduced significantly.

It was concluded that the quality of frozen beef steaks, stored in the Type-A and Type-B three layer multibags was superior compared to regular freezer storage bags (control). The freezer burn was minimized significantly due to the conforming of the inner and middle layers of the three layer bags onto the beef steaks.

LONG TERM RESULTS—TYPE-C

The Type-CC2 and Type-CS2 multibags also performed significantly better than the commercially available freezer bags used as control. Their superior performance can be attributed, with the benefit of hindsight, to the tendency of the liner bag to "conform" to the food and minimize the headspace available for ice formation. It should perhaps be noted that performance advantages of these prototypes were less significant in tests with irregularly shaped food such as broccoli and chicken with bones.

Various properties of the Type-C liner bag and support bag were measured and compared with the corresponding properties of the commercially available freezer bags. For example, the Relative Stiffness (as determined by the equation: $Z=t^3\times TDSM$) of the Type-C liner was 1 to 2 orders of magnitude lower than commercially available "freezer bags" (e.g. 5,300 cubic mils psi compared with 304,000 cubic mils psi).

Another experiment involved comparing a Type-CC multibag as described hereinbefore with a Type-CC multibag having an embossed liner bag. The experiment included the repacking of 5 different types of meat and the evaluation of the multibags against each other and a commercially available freezer bag using a simplified 5 level rating scale. The control bags tested were ZIPLOC brand FREEZER BAGS (control).

PROTOTYPES

The multibags used were duplex bags having a support bag sidewall thickness of 1.75 mil and a liner bag sidewall thickness of 0.6 mil. One multibag had an embossed liner hereinafter designated "embossed liner" and the other multibag had a plain or smooth liner, hereinafter designated "plain liner." Both multibags were constructed of polyethylene. The embossed pattern on the embossed liner bag was uniform diamonds at 16 diamonds per liner inch.

Five samples of each of ground beef, denver steak, boneless/skinless chicken breast, fish fillet, and pork loin rib chop were placed into plain liner multibags, embossed liner multibags and ZIPLOC brand FREEZER BAGS. Each bag had one piece of meat. The bags were placed in a commercial freezer with a set point or 0° F. The freezer was opened at various intervals to observe and evaluate the samples.

RATING SCALE

A rating scale was developed to visually rate ice crystal formation on the surface of the meat samples tested. The rating levels are: "<Low-Low," "Low-Medium (Low-Med)," Medium (Med)," "Medium-High (Med-Hi)," and "High."

"<Low-Low" means no or very small and very fine ice crystals present on the meat surface in ice crystal patches of from ¼ to ½ square inches in area and no freezer burn present.

"Low-Med" means early development of three dimensional ice crystals on the meat surface due to some film lifting and no freezer burn present on film contacted meat surfaces.

"Med" means numerous ice crystals present on the meat surface in patches having an area or greater than ½ square inch, at least ¼ of the total meat surface area having lost film contact, and minor or no freezer burn present.

"Med-Hi" means numerous three dimensional ice crystals present on over ⅓ of the meat surface due to greater loss of film contact and freezer burn is present.

"High" means ice crystals present over at least ½ of the total surface area of the meat and/or freezer burn present.

RESULTS

The results of the freezer tests at freezing times of 17 weeks and 8 months are shown below in Table 1. The numbers in each rating category are the number of meat samples (out of five tested) having that particular rating attribute in the particular time period. The results show that both of the multibags of the present invention prevented ice crystal formation and freezer burn on meats tested compared with the performance of a control.

TABLE 1

| SAMPLE | Low-Low | Low-Med | Med. | Med. Hi | High |
|---|---|---|---|---|---|
| 17 weeks | | | | | |
| Ground Beef | | | | | |
| embossed liner | 4 | 0 | 1 | 0 | 0 |
| plain liner | 4 | 0 | 1 | 0 | 0 |
| Control | 0 | 0 | 4 | 1 | 0 |
| Denver Steak | | | | | |
| embossed liner | 3 | 1 | 1 | 0 | 0 |
| plain liner | 4 | 0 | 1 | 0 | 0 |
| Control | 0 | 0 | 3 | 0 | 2 |
| Boneless/Skinless Ck. Brt | | | | | |
| embossed liner | 5 | 0 | 0 | 0 | 0 |
| plain liner | 5 | 0 | 0 | 0 | 0 |
| Control | 0 | 2 | 2 | 0 | 1 |
| Fish Fillet | | | | | |
| embossed liner | 4 | 0 | 0 | 0 | 1 |
| plain liner | 0 | 1 | 4 | 0 | 0 |
| Control | 0 | 0 | 0 | 0 | 5 |
| Pork Loin Rib Chop | | | | | |
| embossed liner | 5 | 0 | 0 | 0 | 0 |
| plain liner | 5 | 0 | 0 | 4 | 1 |
| Control | 0 | 0 | 0 | 4 | 1 |
| 8 Months | | | | | |
| Ground Beef | | | | | |
| embossed liner | 5 | 0 | 0 | 0 | 0 |
| plain liner | 5 | 0 | 0 | 0 | 0 |
| Control | 0 | 0 | 5 | 0 | 0 |
| Denver Steak | | | | | |
| embossed liner | 5 | 0 | 0 | 0 | 0 |
| plain liner | 5 | 0 | 0 | 0 | 0 |
| Control | 0 | 0 | 0 | 5 | 0 |
| Boneless/Skinless Ck. Brt | | | | | |
| embossed liner | 5 | 0 | 0 | 0 | 0 |
| plain liner | 5 | 0 | 0 | 0 | 0 |
| Control | 0 | 0 | 5 | 0 | 0 |
| Fish Fillet | | | | | |
| embossed liner | 4 | 0 | 1 | 0 | 0 |
| plain liner | 4 | 0 | 1 | 0 | 0 |
| Control | 0 | 0 | 0 | 0 | 5 |
| Pork Loin Rib Chop | | | | | |
| embossed liner | 5 | 0 | 0 | 0 | 0 |
| plain liner | 2 | 0 | 3 | 0 | 0 |
| Control | 0 | 0 | 0 | 3 | 2 |

Although specific embodiments of the present invention have been described, it is to be understood that modifications and variations may be found by those skilled in the art which are within the spirit and scope of the invention.

What is claimed is:

1. A freezer bag comprising a multibag having at least an inner liner bag and an outer support bag, the inner liner bag having first and second sidewalls, each sidewall of the liner having opposing lateral edges and a top edge, the first and second sidewalls of the liner being attached together along the lateral edges to form edge seals, the liner also having a folded edge defining the bottom of the liner, the outer support bag having first and second sidewalls, each sidewall having opposing lateral edges and a top edge, the first and second sidewalls of the support being attached together along the lateral edges to form edge seals, the top edges defining the opening to the multibag, the support bag also having a folded edge defining the bottom of the multibag, wherein the top edges of the liner bag are attached to an inner surface of each respective sidewall of the support bag, the liner bag is a moisture-impervious thermoplastic material and has a nominal sidewall thickness of from about 0.3 mil to about 1.75 mil, and the liner bag is unperforated, unperforated with at least one vent hole, or perforated with microholes of from about 50 microns to about 950 microns in diameter.

2. The freezer bag of claim 1 wherein the top edges of the liner bag are attached to the support bag below the opening of the multibag.

3. A freezer bag according to claim 1 wherein the sidewalls of the liner bag have a nominal thickness of from 0.3 to 1.0 mil.

4. A freezer bag according to claim 3 wherein the liner bag comprises a thermoplastic film having a Transverse Direction 2 percent Secant Modulus (TDSM) of less than 40,000 psi when determined in accordance with ASTM D 832-83, Method A, having a jaw gap of 4 inches for specimens having a 1 inch width, except that the Initial Strain Rate is 0.25 inches per inch per minute with a crosshead speed of 1 inch per minute.

5. A freezer bag according to claim 4 wherein the liner bag comprises thermoplastic film having a Z number of less than 60,000 $mil^3$ psi wherein Z is $(t^3)\times(TDSM)$ where t is the thickness of the film in mils and TDSM is the transverse direction secant modulus in accordance with ASTM D 832-83, Method A, having a jaw gap of 4 inches for specimens having a 1 inch width, except that the Initial Strain Rate is 0.25 inches per inch per minute with a crosshead speed of 1 inch per minute.

6. A freezer bag according to claim 4 wherein the Z number of the liner bag is less than 20,000 $mil^3$ psi.

7. A freezer bag according to claim 3 wherein the support bag comprises film having a Z value in a range of from 50,000 to 150,000 $mil^3$ psi.

8. A freezer bag according to claim 7 wherein the liner bag comprises a thermoplastic film comprising homopolymers and copolymers of ethylene.

9. A freezer bag according to claim 1 wherein the top edges of the liner bag are attached to the sidewalls of the support bag by a hinge-type blanket seal or a heat seal type blanket seal.

10. A freezer bag according to claim 8 wherein the inner surface of the liner bag is textured.

11. A freezer bag according to claim 10 wherein the support bag has mateable male and female closure elements along opposed inner surfaces of the support bag.

12. A freezer bag according to claim 11 wherein the liner bag is additionally attached to the support bag along lateral edges of the liner bag by common edge seals.

13. A freezer bag according to claim 12 wherein the top edges of the liner bag are attached to the sidewalls of the support bag by a blanket seal.

14. A freezer bag according to claim 1 wherein the support bag has at least one vent hole through a sidewall.

15. A freezer bag according to claim 1 further comprising an inner film layer between the liner bag and the support bag.

16. A freezer bag according to claim 15 wherein the attachment of the top edges of the liner bag to the sidewalls of the support bag is discontinuous.

17. The freezer bag of claim 16 wherein the inner film layer is hygroscopic.

18. The freezer bag of claim 17 wherein the hygroscopic film layer is hydroxypropyl methylcellulose or polyvinyl alcohol.

19. The freezer bag of claim 16 wherein the top edges of the liner bag are attached to the sidewalls of the support bag by hot melt adhesive or a hot air hem seal.

20. A freezer bag according to claim 1 wherein the support bag further comprises mateable male and female closure elements along opposed inner surfaces of the support bag.

21. A freezer bag according to claim 1 wherein the liner bag has a color that is different from the color of at least part of the support bag.

22. A freezer bag according to claim 1 wherein the edge seals of the liner bag are separate from the edge seals of the support bag.

23. The bag of claim 1, wherein the inner liner is from about 0.3 mils to about 1.2 mils thick.

24. A multibag comprising exactly two layers, the two layers being an inner layer and an outer layer, the inner layer having two sidewalls attached together along lateral edges, each sidewall having a top edge, the inner layer having a folded edge defining the bottom of the inner layer, the outer layer having two sidewalls attached together along respective lateral edges, each sidewall having a top edge, the outer layer having a folded edge defining the bottom of the outer layer, the top edges of the inner layer being attached to an inner surface of each respective sidewall of the outer layer, wherein the inner layer is a moisture-impervious thermoplastic material and has a nominal sidewall thickness of from about 0.3 mil to about 1.75 mils.

25. The bag of claim 24, wherein the inner layer is from about 0.3 mils to about 1.2 mils thick.

26. The bag of claim 24, wherein the inner layer is from about 0.3 mils to about 1.0 mils thick.

27. The bag of claim 24, wherein the inner layer is embossed.

* * * * *